US012703533B2

(12) United States Patent
Rocchetta et al.

(10) Patent No.: US 12,703,533 B2
(45) Date of Patent: Aug. 11, 2026

(54) METHOD FOR UNDRESSING A PALLET AND RELATED APPARATUS

(71) Applicant: EMS GROUP S.P.A., Montecchio Emilia (IT)

(72) Inventors: Paolo Rocchetta, Montecchio Emilia (IT); Alessandro Ferretti, Montecchio Emilia (IT)

(73) Assignee: EMS GROUP S.P.A., Montecchio Emilia (IT)

( * ) Notice: Subject to any disclaimer, the term of this patent is extended or adjusted under 35 U.S.C. 154(b) by 32 days.

(21) Appl. No.: 18/271,464

(22) PCT Filed: Jan. 12, 2022

(86) PCT No.: PCT/IB2022/050203
§ 371 (c)(1),
(2) Date: Jul. 9, 2023

(87) PCT Pub. No.: WO2022/153184
PCT Pub. Date: Jul. 21, 2022

(65) Prior Publication Data

US 2024/0308713 A1 Sep. 19, 2024

(30) Foreign Application Priority Data

Jan. 12, 2021 (IT) ..... 102021000000482
Dec. 17, 2021 (IT) ..... 1020210000031688

(51) Int. Cl.
*B65B 69/00* (2006.01)

(52) U.S. Cl.
CPC ..... *B65B 69/0033* (2013.01); *B65B 69/00* (2013.01)

(58) Field of Classification Search
CPC ..... B65B 69/0033; B65B 69/00
See application file for complete search history.

(56) References Cited

U.S. PATENT DOCUMENTS 2,729,885 A * 1/1956 Wahl ..... B65B 69/0033 414/412
3,606,058 A * 9/1971 Davis ..... B65B 69/0033 414/412

(Continued)

FOREIGN PATENT DOCUMENTS

DE 4311421 A1 10/1994
EP 3214004 B1 9/2018

(Continued)

*Primary Examiner* — Shelley M Self
*Assistant Examiner* — Katie L Gerth
(74) *Attorney, Agent, or Firm* — Carmel Patent Agency; Robert Ballarini

(57) ABSTRACT

A method for undressing a pallet of products arranged in layers on a base, the pallet being coated with a protective film for retaining and protecting the products with the film adapted to cover the upper surface and the side surface of the pallet, includes separating the protective film into two segments each having an upper flap of an upper portion of film at the upper surface of the pallet and a lower flap of a side portion of film at the side surface of the pallet. The method also includes making the two segments by performing near the base a first cut extending in a substantially horizontal direction along the side surface and at least a second cut extending in a substantially vertical direction along two sides opposite each other of the side surface and a third cut extending on the upper surface of the pallet.

17 Claims, 31 Drawing Sheets

(56) References Cited

U.S. PATENT DOCUMENTS

| | | | | |
|---|---|---|---|---|
| 3,889,442 | A * | 6/1975 | Grahn | B65B 43/38 414/412 |
| 5,148,651 | A * | 9/1992 | Masuda | B65B 69/0033 53/381.1 |
| 5,463,841 | A * | 11/1995 | Hayakawa | B65B 69/0033 53/381.2 |
| 5,727,747 | A * | 3/1998 | Hannen | B65B 69/0033 242/532.5 |
| 6,174,122 | B1 | 1/2001 | Krooss et al. | |
| 2004/0099110 | A1 * | 5/2004 | Cere | B65B 69/0033 83/559 |
| 2009/0301031 | A1 * | 12/2009 | Jacobs | B65B 69/0033 414/412 |
| 2012/0222536 | A1 * | 9/2012 | Sain | B65B 69/0033 83/743 |
| 2019/0023442 | A1 * | 1/2019 | Gibert Guasch | B65B 69/0033 |
| 2023/0159208 | A1 * | 5/2023 | Bjerring | B65B 69/00 53/492 |

FOREIGN PATENT DOCUMENTS

| | | | |
|---|---|---|---|
| KR | 101063899 | B1 | 9/2011 |
| KR | 102054922 | B1 | 12/2019 |
| WO | 2008052176 | A2 | 5/2008 |

* cited by examiner

FASE 1

FASE 1

FASE 1

FASE 3

FASE 2

FASE 5

FASE 6

FASE 6

FASE 7

FASE 7

FASE 8

FASE 8

METHOD FOR UNDRESSING A PALLET AND RELATED APPARATUS

FIELD OF THE INVENTION

The present invention falls within the field of undressing a palletized load. In particular, it relates to a method and related apparatus for ensuring the withdrawal of the protective film of a palletized load.

STATE OF THE ART

The packaging or bottling plants, for example, are fed palletized loads consisting of various layers of products or containers surrounded by a heat-shrinkable or elastic envelope that covers said products.

Palletized load or pallet mean a plurality of products preferably arranged in layers on a base also known as a pallet, generally made of wood or plastic. Between each layer there may be an insert called pad made of plastic or cardboard that helps the stability of the pallet. It is also possible for said pad to be positioned between the pallet and the load.

In the event that returnable plastic inserts are used in the palletized load, these elements must be kept for future use.

Prior to depalletizing the product in the treatment lines, such as for example the filling lines if it is a container like bottles or jars, said pallet is stored and moved between the product production plants and the subsequent treatment plants. To guarantee the integrity and stability thereof during the various steps mentioned above, the pallet is generally wrapped with a protective film that defines an envelope in which the products are enclosed. Said film is generally of the plastic type.

In the case of containers for the food industry, the film completely wraps the products and the pallet on which the load is supported to ensure that insects and dirt cannot get in as well as to give stability to the palletized load.

Said envelope can be applied by wrapping the perimeter surface of the pallet with a stretch film or by fitting a heat-shrinkable type film on the pallet that adheres to the perimeter surface of the pallet by heat-shrinking. Alternatively, the pallet can be wrapped in a stretch-hood type film that is fitted onto the pallet and adapts thanks to its elasticity characteristics, without the need to adhere by heat-shrinking.

Even a perimeter portion of the base of the pallet can be wrapped in the protective film.

The operation of withdrawing the protective film from the pallet, which in jargon is called pallet undressing, is very often carried out manually. In fact, the variables linked to the stability of the product and the non-uniform adhesion of the protective film, the possibility of damaging the product and/or pads has always made undressing by automatic machines unreliable.

At the same time, however, manual undressing performed by one or more operators is an operation which, in addition to entailing risks in terms of the integrity of the palletized load, also entails risks in terms of safety of the operator.

In fact, during undressing, the operator may find himself in a dangerous situation due to possible products falling off that are dragged by the withdrawn film.

In order to overcome this drawback, some automatic means and methods for undressing the pallet are known in the state of the art.

Said means and methods present a series of problems in particular when the pallet load comprises many unstable and fragile products such as for example pallets of glass bottles.

U.S. Pat. No. 5,727,747 describes a method and machine for removing an envelope from a palletized load in which a continuous vertical cut is carried out in the envelope and by means of a relative rotation movement between the pallet and the envelope, the envelope is withdrawn by unrolling the plastic film from the pallet by tearing.

The main problem with this machine and method is that, especially in the case of undressing with heat-shrinkable type film, said plastic film has creases or folds that change from area to area the behavior of the film during tearing and the relative behavior of the load during the unwinding process.

As a result, the load can tilt, get caught in the film and even the partial dropping of the bottles of the load can occur.

This causes the production line to stop, as the situation cannot always be resolved quickly.

A further machine and method for undressing is described in document EP3214004B1 which provides for performing vertical and/or horizontal linear cuts in a plastic material surrounding the palletized load. At least one of the linear cuts is of the discontinuous type and comprises a cutting portion with a plurality of cuts of determined length and constant pitch; said method provides a subsequent step which consists in tearing off said discontinuous cutting portion. Said discontinuous cutting portion is vertical and is made on a side face of the palletized load and is connected to a cut made in the upper base of the palletized load.

This method also has the disadvantage of withdrawing the film by tearing, which highlights the same problems as described above, especially in the case of heat-shrinkable film.

A further problem of known methods and machines is also given by the difficulties in performing the cut and by the type of tools for cutting the film, which can come into contact with the containers; this aspect is particularly relevant in light of consumer food safety aspects, especially for glass containers (such as bottles or jars), due to the possible loss of resistance and integrity.

Contact of the cutting tools with the containers can cause damage to the outer walls, mouths or necks of the containers.

Document EP3214004B1, to overcome the aforementioned problem, provides for carrying out the cut of the film by inserting the blade between each row of bottles, but this is not always possible because it depends on the correct positioning of the bottles on the pallet which is not always guaranteed due to palletizing errors or due to displacements after moving the pallet.

Furthermore, a further critical aspect of undressing a pallet is linked to the evacuation of the film once it has been withdrawn, as it takes up large spaces and does not allow for easy disposal.

SUMMARY

The technical problem underpinning the present invention is that of making available a method and related apparatus for undressing a pallet of products structurally and functionally designed to overcome one or more of the limits set forth above with reference to the known prior art.

Within the scope of the aforementioned problem, a main object of the invention is to develop a method and related apparatus for undressing a pallet of products that allows to minimize the risk of falling and damage to the palletized product and consequent system failures or stoppages.

A further object of the invention is also that of making available to the art a method and related apparatus for undressing a pallet of products as part of a flexible solution that can be adapted to the frequency and spaces of the downstream depalletizing line.

In particular, the present invention describes a method for undressing a pallet of products.

Preferably, said products are arranged in layers on a base or plate called pallet.

Said pallet is coated with a protective film for retaining and protecting the products themselves, said film adapted to cover the upper surface and the side surface of the pallet preferably up to the base.

Said method preferably provides for separating said protective film into at least two segments each comprising an upper flap of an upper portion of film at the upper surface of the pallet and a lower flap of a side portion of film at the side surface of the pallet.

Preferably, said method provides for performing said two segments, performing a first cut near the base extending in a substantially horizontal direction along each side of the side surface.

It preferably provides for making at least a second cut extending in a substantially vertical direction along two preferably opposite sides of the side surface.

It preferably provides for a third cut extending on the upper surface of the pallet preferably in a direction parallel to at least one of the two sides.

Thanks to this solution, the detachment of the film from the pallet is facilitated reducing product fall.

Said method preferably provides for the first cut to be near the base.

In particular, it provides for performing a first portion and a second portion of the first cut on two successive sides of the pallet, respectively.

According to a preferred aspect, it therefore provides for rotating the pallet around a vertical symmetry axis thereof and performing a third portion and a fourth portion of the first cut on the remaining two successive sides.

A preferred embodiment provides that the second cut comprises a first section extending on one side up to the upper surface and a second section extending on another side up to the upper surface.

Preferably, the method includes performing the first section of the second cut, then rotating the pallet around a vertical symmetry axis thereof and performing the second section.

Preferably it provides that the third cut comprises a first and a second upper section extending up to the center of the upper surface, preferably on opposite sides.

In particular, the method may provide that the first section of the second cut intersects the first portion or the second portion of the first cut and preferably the second section of the second cut intersects the third portion or the fourth portion of the first cut.

Preferably, the first and second upper section of the third cut can be made in continuity with the first and second section of the second cut, respectively.

In particular, said segments of film are carried away from the pallet by means of withdrawal means.

The method may include performing a centering step, preferably of the upper layers of the pallet before said segments are carried away from the pallet.

It preferably provides, prior to the start of cutting, for positioning retaining means between the product and the film, retaining said film in contact with the blade.

In particular, it includes making the first, second and third cut with a first anthropomorphic robot.

Furthermore, it preferably includes moving the segments away from the pallet by means of a second anthropomorphic robot.

The invention also relates to the apparatus for making a plurality of cuts and related movement of the film away from the pallet according to the method described above.

In particular, said apparatus comprises a cutting device for cutting the protective film.

Preferably said apparatus is configured to make near the base a first cut extending in a substantially horizontal direction along each side of the side surface.

Preferably, the apparatus is configured to make at least one second cut extending in a substantially vertical direction along two preferably opposite sides of the side surface.

Preferably, the apparatus is configured to also make a third cut extending on the upper surface of the pallet preferably in a direction parallel to at least one of the two sides.

In particular, the apparatus comprises means for withdrawing the protective film, configured to move the segments of protective film made with the cutting device away from the pallet.

According to a preferred embodiment, the apparatus comprises a first anthropomorphic robot on which the cutting device is installed to perform the first, second and third cut, and preferably the withdrawal means are installed on said first anthropomorphic robot to move the segments away from the pallet.

An alternative embodiment provides that the apparatus comprises a second anthropomorphic robot on which the withdrawal means are installed to move the segments away from the pallet.

Preferably, said apparatus comprises transfer and/or support means configured to position the pallet in the work area of the first anthropomorphic robot and/or of the second anthropomorphic robot.

Said transfer and/or support means preferably comprise a rotating device configured to rotate the pallet around a vertical symmetry axis thereof, when it is positioned at the first anthropomorphic robot performing the cutting.

Preferably the apparatus, comprises a centering device configured to perform a centering step with respect to the vertical symmetry axis, preferably of the upper layers of the pallet.

Preferably the cutting device comprises a blade.

Said blade is preferably of the circular type and rotated by actuating means.

Preferably, the cutting device further comprises adaptation elements adapted to support the blade and configured to adapt to the shape of the pallet.

In particular, the cutting device may further comprise a protective element configured to interpose between the product and the film to retain said film near the blade.

Preferably the protective element is in a fixed position with respect to the blade.

Preferably the protective element is configured such that the blade is embedded in the thickness of said protective element, preferably without protruding therefrom.

A preferred embodiment provides that the cutting device further comprises at least one detachment device.

Said detachment device can comprise a suction head configured to move a portion of film away from the pallet and assist in inserting the protective element.

According to one aspect of the invention, the withdrawal means comprise at least one gripping device comprising a grasping head configured to move a portion of film away from the pallet.

Preferably, said withdrawal means comprise a locking device adapted to securely retain a flap of the segment which has been previously moved away from the pallet by means of the gripping device.

In particular, the present invention also relates to an apparatus for undressing a pallet of products which comprises cutting devices and means for withdrawing the protective film.

Preferably, said cutting devices are configured to separate said protective film into at least two segments each comprising an upper flap of an upper portion of film at the upper surface of the pallet and a lower flap of a side portion of film at the side surface of the pallet, said segments being carried away from the pallet by the withdrawal means.

In particular, the cutting devices are configured to separate at least one upper flap of the segment by performing, on the upper portion of film, a first horizontal cut extending from one side of the side surface to the respective symmetrically opposite side or alternatively from an edge of the side surface to the respective diagonally opposite edge; said cutting devices are further configured to separate at least one lower flap of the segment by performing on the side portion of the film a first and a second vertical cut which are the continuation, preferably in a vertical direction, of the ends of the first horizontal cut along the corresponding side or the corresponding edge of the side surface, preferably throughout the entire height of the pallet.

According to a preferred aspect of the invention, the cutting devices can separate a plurality of segments, preferably four in number. This solution is particularly advantageous when the products on the pallet are unstable, since dividing a greater number of segments makes it possible to improve the ease with which the segment are moved away from the pallet and reduces the possibility that the film can drag along the products.

In one example, the cutting devices may separate the upper flap of the segment by performing, on the upper portion of film, at least a second horizontal cut, intersecting the first horizontal cut at an point of intersection, and extending from a side of the side surface to the respective symmetrically opposite side or alternatively from an edge of the side surface to the respective diagonally opposite edge; said cutting devices are further configured to separate the lower flap of the segment by performing, on the side portion of the film, at least a third and fourth vertical cut which are the continuation, preferably in a vertical direction, of the second horizontal cut along the corresponding side or the corresponding edge of the side surface, preferably throughout the entire height of the pallet.

Alternatively, the cutting devices are configured to separate the upper flaps by performing, on the upper portion of film, a first pair of cuts intersecting each other at a first point of intersection located in a central area of the upper surface and a second pair of horizontal cuts intersecting each other at a second point of intersection located in the central area of the upper surface and wherein said first pair of cuts extends from said first point of intersection up to the two adjacent sides or alternatively up to the two adjacent edges of the side surface and said second pair of horizontal cuts extends from said second point of intersection up to the two adjacent sides or alternatively up to the two adjacent edges, said two sides or two edges being opposite those of the first pair of horizontal cuts. Further, the cutting devices are configured to separate the lower flap by performing, on the side portion of the film, a first pair of vertical cuts and a second pair of vertical cuts which are the continuation, preferably in a vertical direction, respectively of the first pair of horizontal cuts and of the second pair of horizontal cuts along the corresponding side or the corresponding edge of the side surface, preferably throughout the entire height of the pallet.

These are all embodiments of film cutting that are particularly advantageous for the aspects described above.

According to a preferred embodiment, the cutting device comprises a blade, preferably of the circular type, rotated by actuating means.

The circular blade allows to combine the cutting capacity of the blade itself with a greater effectiveness due to rotation.

Preferably, the cutting device further comprises retaining means configured to interpose between the product and the film to retain said film near the blade.

Thanks to this solution, the blade is able to cut continuously during all the cutting steps, without losing the film and furthermore the blade does not come into contact with the product, avoiding any risk of damage.

According to a preferred constructive embodiment, the withdrawal means are configured to withdraw the upper flap preferably near the points of intersection, carrying it away from the upper surface of the pallet.

Preferably said withdrawal means are configured to release said upper flap to at least one evacuation device of the apparatus.

In particular, said evacuation device comprises dragging means configured to receive the upper flap from the withdrawal means and exert traction forces on the segment in order to detach it from the pallet and preferably from the base or from a possible second film adhering to said base.

Thanks to this solution, the cut segments are moved away from the pallet gradually.

Said evacuation device may comprise shredding means configured to cut/shred the film of each segment into small portions before their evacuation and preferably are configured to cut/shred said upper flap and progressively said lower flap in particular receiving said upper flap from the dragging means.

Thanks to this solution, the film is not only withdrawn from the pallet, but is also processed for subsequent disposal thereof.

The invention also relates to the method for making segments and related movement away from the pallet as described above.

These and other objects are reached by the characteristics of the invention as set forth in the independent claims. The dependent claims outline preferred and/or particularly advantageous aspects of the invention.

Said purposes and advantages are all achieved by the method and related apparatus for undressing a pallet of products, which is the subject matter of the present invention, and which is characterized by what is provided for in the appended claims.

BRIEF DESCRIPTION OF THE DRAWINGS

These and other features will be more apparent from the following description of certain embodiments illustrated by way of non-limiting example in the accompanying drawings.

DETAILED DESCRIPTION OF THE PREFERRED EMBODIMENTS

Figure 3:
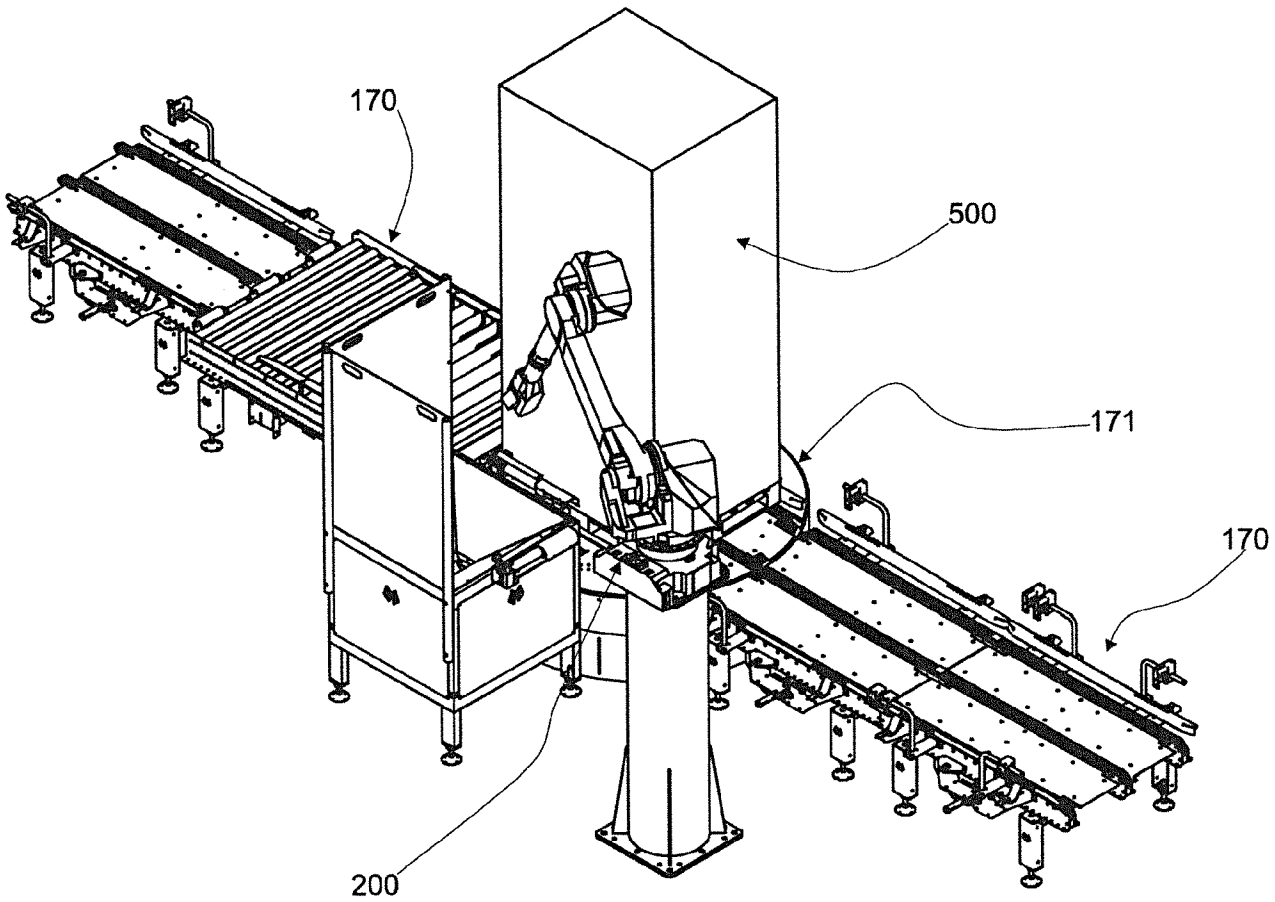
FIG. 3: illustrates an axonometric view of an apparatus for undressing pallets according to the invention with a single anthropomorphic robot.
Figure 4:
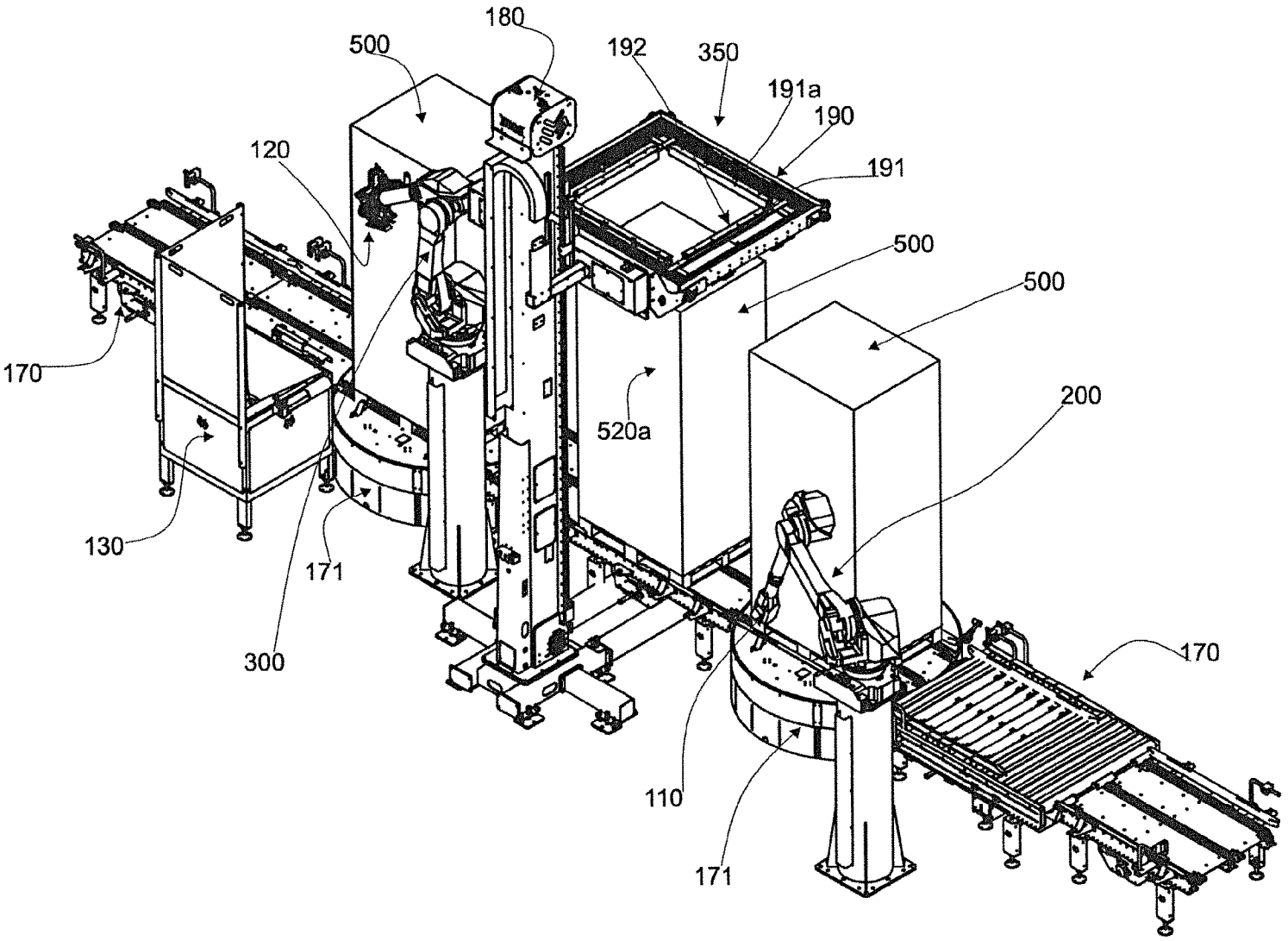
FIG. 4: illustrates an axonometric view of an apparatus for undressing pallets according to the invention with two anthropomorphic robots and a centering device.

With particular reference to FIGS. 3 and 4, an apparatus 100 for undressing a pallet 500 of products 510, preferably arranged in layers on a base or plate 520, is depicted.

Said pallet 500 is coated with a protective film 550 for retaining and protecting the products 510 themselves. Said protective film 550 is configured to cover the upper surface 501 and the side surface 502 of the pallet 500 preferably at least up to the base 520, so as to ensure greater sealing for stability and for insulation from the outside.

The pallet 500 can have various approximate dimensions, generally ranging from 600×800 mm up to 1120×1420 mm and heights generally up to 3000 mm. The apparatus 100, described below, is capable of processing pallets 500 of various sizes.

Figure 2:
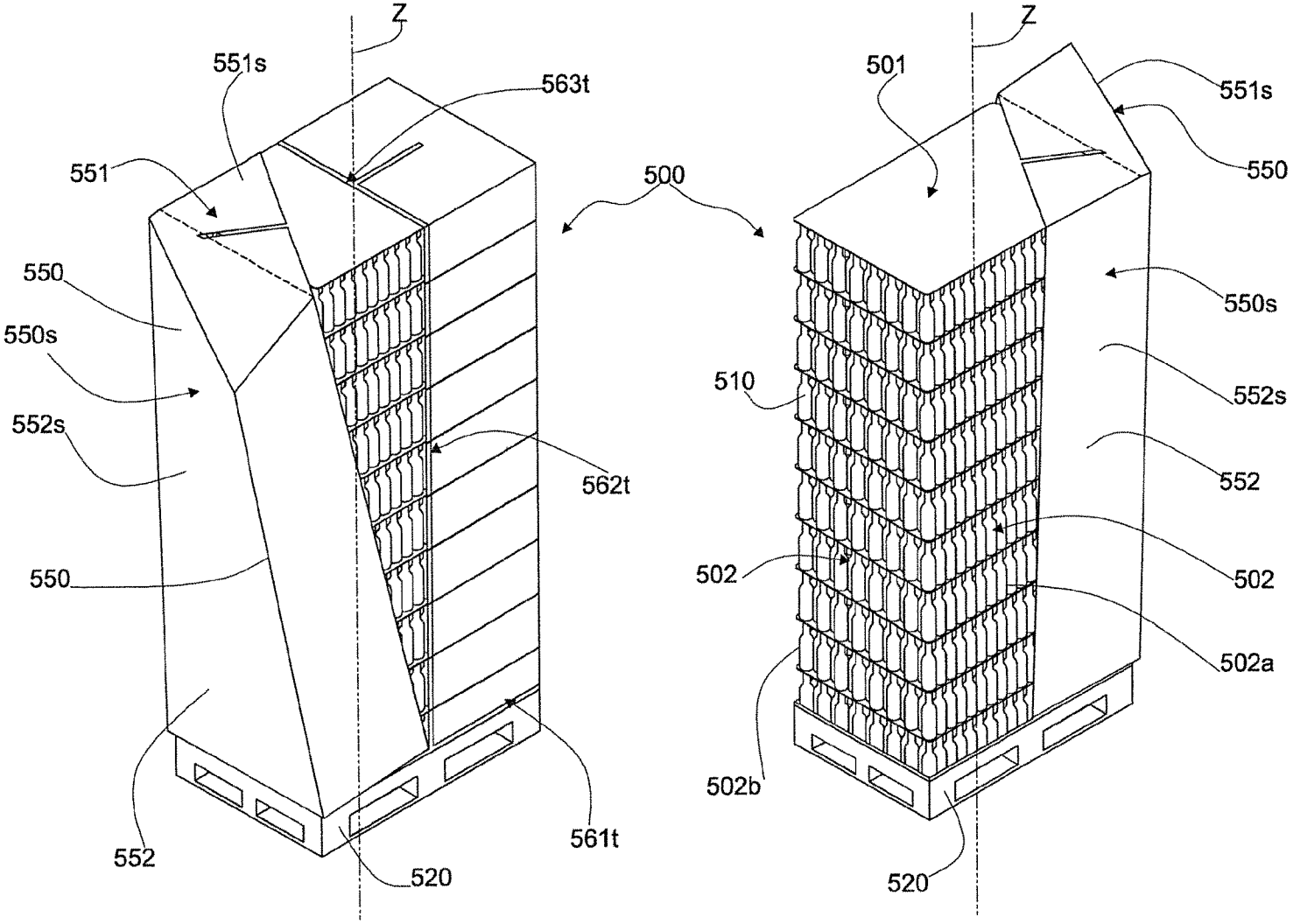
FIG. 2: illustrates in an axonometric view a pallet with cuts and related subdivision into two segments.

The protective film 550 therefore comprises an upper portion 551 at the upper surface 501 of the pallet 500 and a side portion 552 at the side surface 502 of the pallet 500. As depicted in FIG. 2, the side portion 552 extends on all four sides 502*a* of the side surface 502 of the pallet 500. Likewise in FIG. 2, the four edges 502*b* of the side surface 502 are identified.

In particular, said apparatus 100 comprises a cutting device 110 for cutting the protective film 550 on the pallet 500 and preferably withdrawal means 120 for withdrawing the protective film 550 from the pallet 500, once it has been cut.

Said cutting device 110 cuts the film 550 defining and separating portions of said film 550.

According to one aspect of the invention said cutting device 110 is configured to separate said protective film 550 into two segments 550*s*.

The term "segment" means a portion of protective film 550 separated from the remaining film 550 by cutting. More precisely, according to a preferred embodiment, each segment 550*s* comprises an upper flap 551*s* of the upper portion 551 of film 550 and a lower flap 552*s* of the side portion 552 of film 550.

Advantageously, each segment 550*s* is carried away from the pallet 500 by the withdrawal means 120.

In accordance with an aspect of the invention, said apparatus is configured to perform a first cut 561*t* on the side portion 552 near the base 520.

In particular, said first cut 561*t* extends in a substantially horizontal direction along each side 502*a* of the side surface 502.

Further preferably said apparatus 100 is configured to perform at least a second cut 562*t* on the side portion 552.

In particular, said second cut 562*t* extends in a substantially vertical direction along two sides 502*a*.

Said two sides 502*a* are preferably two opposite sides 502*a* of the side surface 502.

A preferred embodiment provides for performing a third cut 563*t* extending on the upper surface 501 preferably in a direction parallel to at least one of the two sides 502*a*.

This allows the complete separation of two segments 550*s* from each other and from the remaining protective film 550.

Therefore, the movement of each of the two segments 550*s* away from the pallet 500 does not require a tearing action for the complete separation from the remaining protective film 550.

In accordance with an aspect of the invention, once the two segments 550*s* have been made, the withdrawal means 120 may operate in order to move said segments 550*s* of protective film 550 away from the pallet 500.

A preferred embodiment depicted in FIG. 3 provides that said apparatus 100 comprises a first anthropomorphic robot 200 on which the cutting device 110 is installed to make the first the second and third cut 561*t*, 562*t*, 563*t*.

According to an embodiment not depicted in FIG. 3, the withdrawal means 120 can be installed on said first anthropomorphic robot 200 to move the segments 550*s* away from the pallet 500.

A 2- or 3-axis Cartesian robot also falls within the definition of an anthropomorphic robot.

This solution allows a compact apparatus 100 to be realized which reduces the overall dimensions in the positioning layout inside a factory.

Alternatively, as depicted in FIG. 4, the apparatus 100 may comprise a second anthropomorphic robot 300 on which the withdrawal means 120 are installed to move the segments 550*s* away from the pallet 500.

Therefore, said apparatus 100 will comprise the first anthropomorphic robot 200 on which the cutting device 110 is installed and the second anthropomorphic robot 300 on which the withdrawal means 120 are installed.

This solution, compared to the previous one, occupies more spaces in the layout for the positioning within a factory, but allows an apparatus 100 to be realized which is capable of achieving higher production rates.

Thus, one or the other embodiment solution will be chosen depending on the requirements of the undressing line.

The apparatus 100 subject-matter of the invention may further comprise transfer and/or support means 170 configured to position the pallet 500 in the work area of the first anthropomorphic robot 200.

In the event that the apparatus also comprises the second anthropomorphic robot 300, said transfer and/or support means 170 will preferably be configured to stretch until the pallet 500 is positioned in the work area of the second anthropomorphic robot 300.

In particular, the base 520 of the pallet 500 rests on said transfer and/or support means 170 which are suitably configured to move the pallet 500 into the undressing position and to support it during undressing operations. We will not go into detail about said transfer and/or support means 170 as they are known to a person skilled in the art as conveyors with chains, rollers, etc. which are chosen for example according to the type of the base 520 and/or the type of pallet 500. Said transfer and/or support means 170 have also been schematized in the figures.

Said transfer and/or support means 170 preferably comprise a rotating device 171 configured to rotate the pallet 500 around a vertical symmetry axis Z thereof.

In particular, said rotating device 171 allows the rotation of the pallet 500 when it is positioned at the first anthropomorphic robot 200.

In fact, the method provides for carrying out the first, second and third cut 561*t*, 562*t*, 563*t* by means of a sequence of steps which also includes a step of rotation of the pallet 500.

In this configuration, the rotating device 171 is configured to rotate the pallet 500 by at least 180°.

Said rotating device 171 in particular cooperates with the first anthropomorphic robot 200 on which the cutting devices 110 are installed such that said cutting devices 110 can perform the cutting steps as described in the method.

The rotation of the pallet 500 allows a wide range of anthropomorphic robots to be used even with a small work area.

The method subject-matter of the invention is preferably carried out with the apparatus 100 which will be further described below.

In particular, said method provides for making said two segments 550*s* by performing a first cut 561*t* on the side surface 502 near the base 520.

Said first cut 561*t* extends in a substantially horizontal direction along each side 502*a* of the side surface 502.

Furthermore, it preferably provides for performing a second cut 562*t* on the side surface 502.

Said second cut 562*t* extends in a substantially vertical direction along two preferably opposite sides 502*a* of the side surface 502.

Advantageously, said method provides for a third cut 563*t* extending on the upper surface 501 of the pallet 500 preferably in a direction parallel to at least one of the two sides 502*a*.

This allows the complete separation of two segments 550*s* from each other and from the remaining protective film 550.

Therefore, the movement of each of the two segments 550*s* away from the pallet 500 does not require a tearing action for the complete separation from the remaining protective film 550.

According to a preferred embodiment, the method provides that the first cut 561*t* is carried out near the base 520.

Figure 1:
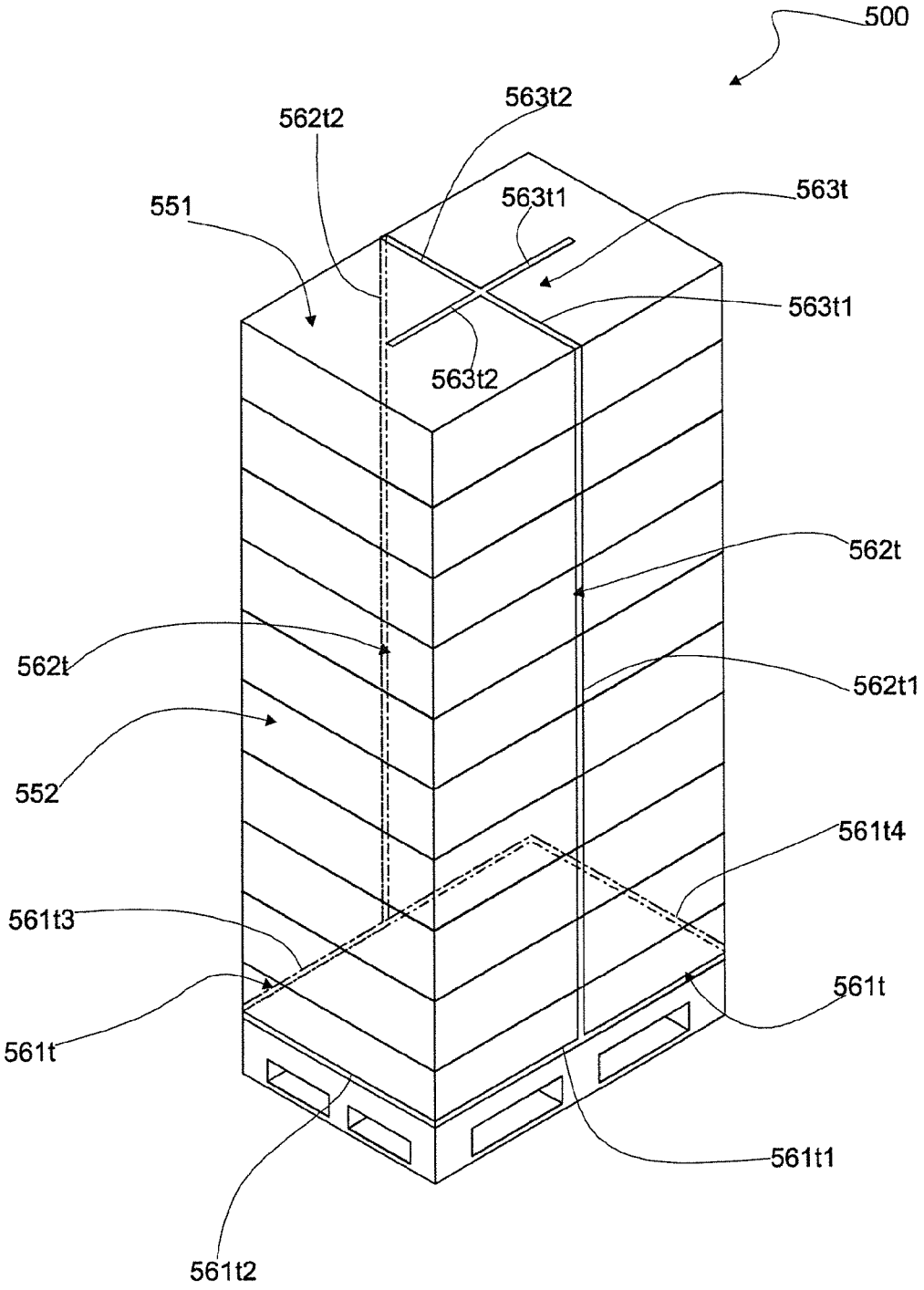
FIG. 1: illustrates in an axonometric view a pallet with visible cuts and hidden dashed cuts.
Figure 5A:
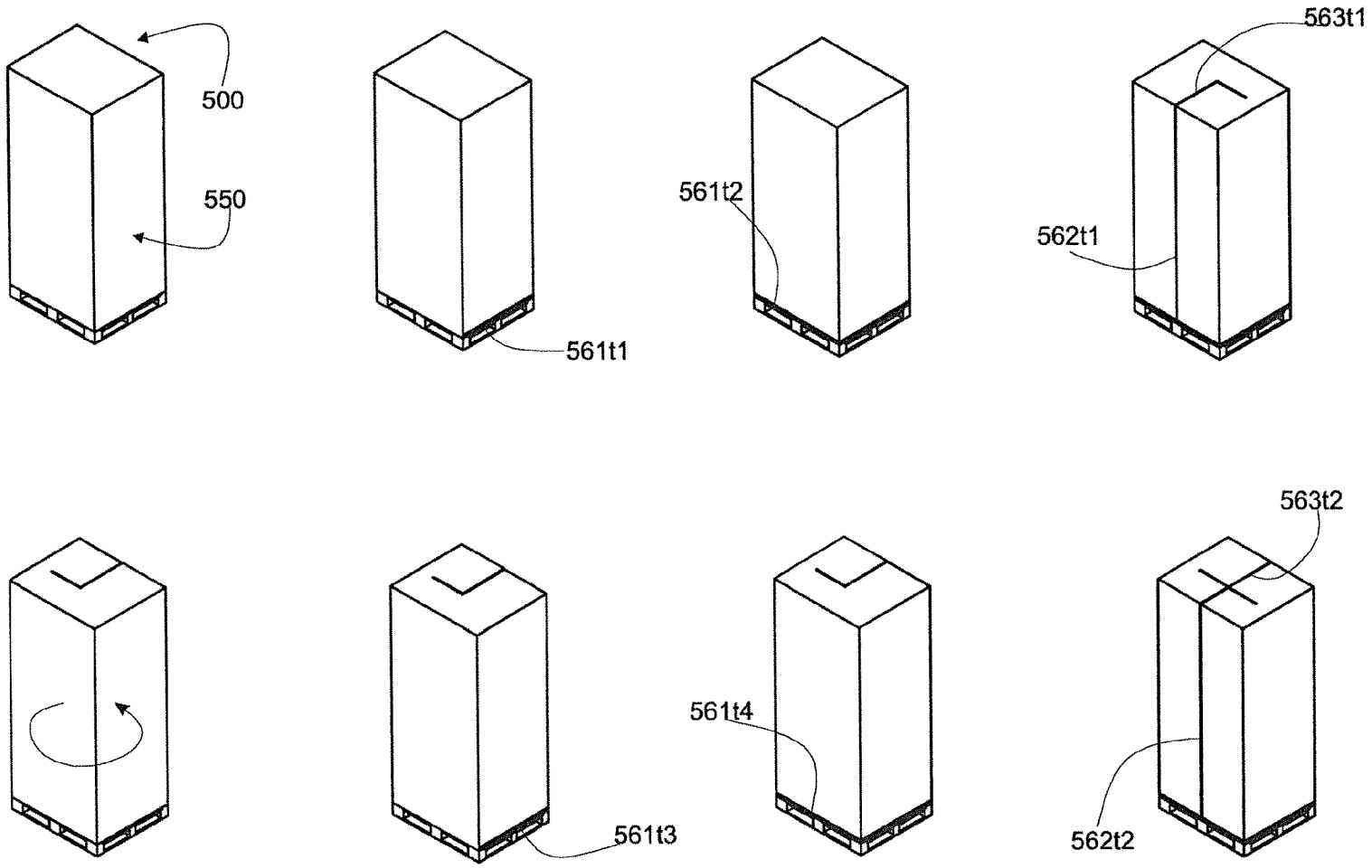
FIG. 5*a*, 5*b*: illustrates two possible sequences of the film cutting steps.
Figure 5B:
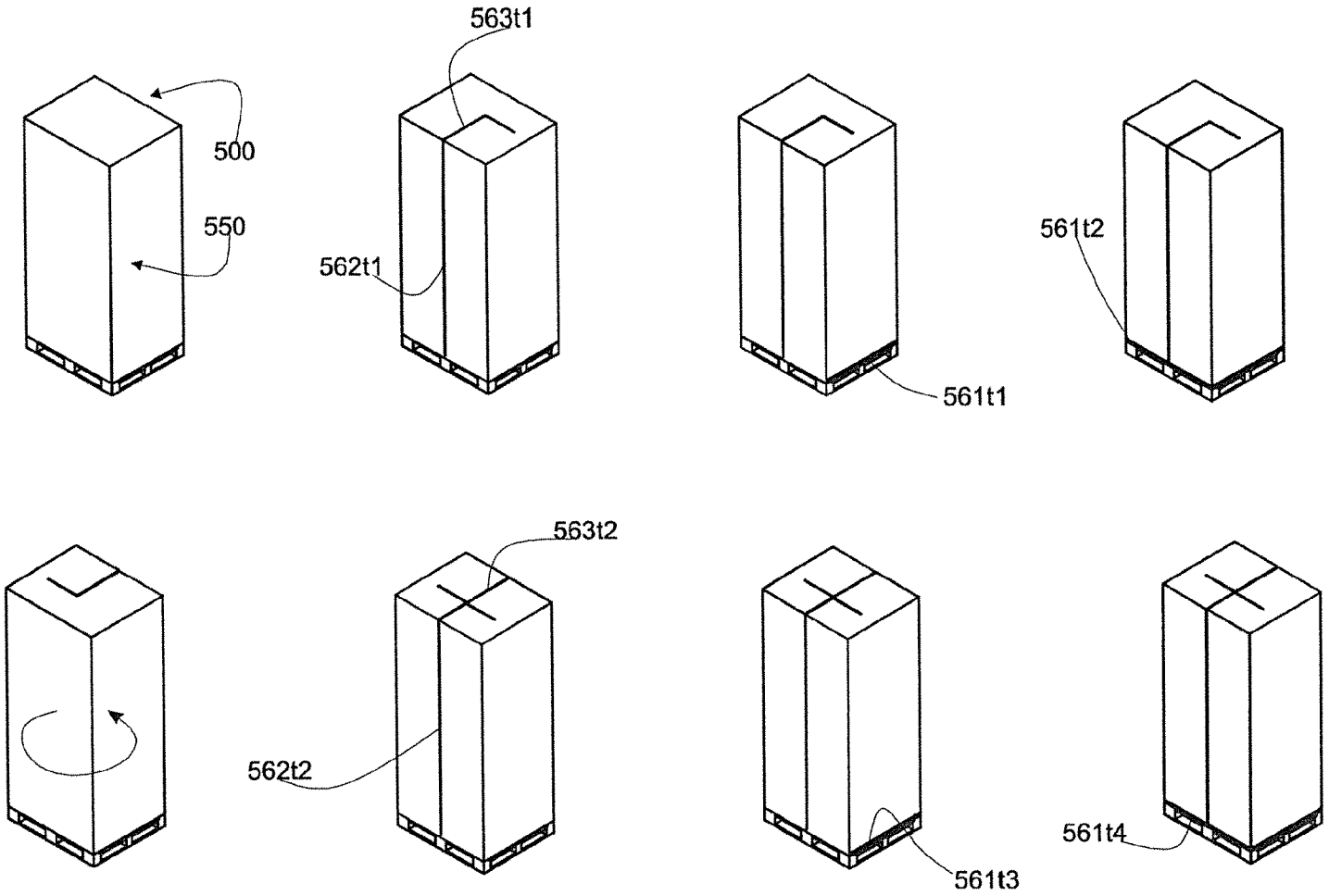

As depicted in FIGS. 1, 5*a* and 5*b* by the term, near the base 520, it is meant that said first cut 561*t* may be carried out in an area between the first layer and the base 520, or in a lower area of the pallet 500 slightly above the base 520. For example, in this second case the first cut 561*t* can be carried out just above the first layer or the first layers if the products 510, which make up the pallet 500, have a reduced height.

Thanks to the position of this first cut 561*t*, the film 550 is separated above the area in which it is generally more difficult to cut said film 550 as it presents irregularities and overlaps due to heat-shrinking. In fact, a plurality of heat-shrunk overlapped films can generally be found at the base 520, which generates seams that are difficult to cut.

Said method can provide for performing said first cut 561*t* in several steps which provide for:

- performing a first portion 561*t*1 and a second portion 561*t*2 respectively on two successive sides 502*a* of the pallet 500,
- rotating the pallet 500 around a vertical symmetry axis Z thereof
- performing a third portion 561*t*3 and a fourth portion 561*t*4 of the first cut 561*t* on the remaining two successive sides 502*a*.

According to one aspect of the invention, the method provides that the second cut 562*t* comprises a first section 562*t*1 extending on one side 502*a*, preferably from the base 520 up to the upper surface 501 and a second section 562*t*2 extending on another side 502*a* up to the upper surface 501.

Preferably, the first section 562*t*1 and the second section 562*t*2 occur on opposite sides 502*a*, as depicted in FIGS. 1, 5*a* and 5*b*.

Preferably, the first section 562*t*1 and the second section 562*t*2 occur substantially vertically and preferably in a central area of the respective sides 502*a*.

It is to be understood that also possible alternatives in which said first section 562*t*1 and second section 562*t*2 are made in an inclined direction, are considered from now on as falling within the same scope of protection.

Said method can provide for performing said second cut 562*t* in several steps which provide for:

- performing the first section 562*t*1 of the second cut 562*t*,
- rotating the pallet 500 around the vertical symmetry axis Z thereof,
- performing the second section 562*t*2.

Preferably the method provides that the first section 562*t*1 of the second cut 562*t* intersects the first portion 561*t*1 or the second portion 561*t*2 of the first cut 561*t* already made or to be made subsequently and preferably the second section 562*t*2 of the second cut 562*t* intersects the third portion 561*t*3 or the fourth portion 561*t*4 of the first cut 561*t*, already made or to be made subsequently.

FIG. 1 depicts a possible embodiment of the cut which provides that the first section 562*t*1 of the second cut 562*t* intersects the first portion 561*t*1 of the first cut 561*t* and the second section 562*t*2 of the second cut 562*t* made on the opposite side 502*a* intersects the third portion 561*t*3 of the first cut 561*t*.

Therefore, one embodiment provides that the cutting device 110 begins to carry out the first section 562*t*1 starting from the cut already carried out near the base 520 and continuing upwards.

Vice versa, the method may provide that the cutting device 110 begins to carry out the first section 562*t*1 and then performs the first portion 561*t*1 or the second portion 561*t*2 of the first cut 561*t* so that at least one intersects the first section 562*t*1 already made.

Both solutions allow to guarantee the complete detachment of the segment 550*s*.

In accordance with an aspect of the invention, the method may provide that the third cut 563*t* comprises a first and second upper section 563*t*1, 563*t*2 extending up to substantially the center of the upper surface 501, preferably starting from opposite sides 502*a*.

Preferably said first and a second upper section 563*t*1, 563*t*2 may be straight or each comprise a plurality of sections, for example straight and/or curvilinear and orthogonal to each other.

In particular, if several sections are envisaged, these are made in continuity with one another, i.e. without interruption of the cut.

A preferred embodiment of the method may provide that the first and second upper section 563*t*1, 563*t*2 of the third cut 563*t* are made in continuity with the first and second section 562*t*1, 562*t*2 of the second cut 562*t* respectively, i.e., without interruption of the cut.

Therefore, preferably, the cutting device 110 starts carrying out the first section 562*t*1 and continues to perform the first upper section 563*t*1 by passing from the side 502*a* to the upper surface 501 without interrupting the execution of the cut.

The same preferably happens with the second section 562*t*2 and the second upper section 563*t*2.

Thanks to this solution, there is more certainty about the complete separation of the two segments 550*s*.

If the work area of the first anthropomorphic robot 200 allows it, alternatively the first and second upper section 563*t*1 563*t*2 can be made in a single continuous cut.

In such a case, for example, the cutting device 110 starts carrying out the first section 562*t*1 and continues by performing the first upper section 563*t*1 which this time extends beyond the center of the upper surface 501 and preferably until reaching the opposite end of the upper surface 501.

The sequence of the cuts, as described above, is not binding as will be explained more precisely below.

Once the cutting step has been finished and the two segments 550*s* have been completely cut, said method provides for said segments 550*s* of film 550 to be carried away from the pallet 500 by the withdrawal means 120.

Before moving said segments 550*s* of film 550 away from the pallet 500, the method preferably provides for performing a step of centering, preferably, the upper layers of the pallet 500 before said segments 550*s* are carried away from the pallet 500.

To advantageously do this, the apparatus 100, may comprise a centering device 350 configured to perform a step of centering the pallet 500 with respect to a vertical symmetry axis thereof Z.

In particular, the centering is particularly effective at the upper layers of the pallet 500.

In fact, precisely these layers can undergo a greater displacement and misalignment, especially after the protective film 550 has been cut and no longer exerts a retaining action.

To reduce the risk of products falling when the film 550 is withdrawn, it is preferable to center the upper layers of the pallet 500.

Therefore, the centering device 350 is preferably positioned near the anthropomorphic robot 200, which comprises the cutting means 110.

This makes it possible to optimize the stability of the products before moving the pallet 550 from the position where the cut was carried out.

An alternative solution provides for the centering device 350 to be positioned near the anthropomorphic robot 300, which comprises the withdrawal means 120.

In the event that said withdrawal means 120 are installed on the second anthropomorphic robot 300, the centering device 350 may be installed such that the position in which the pallet 500 is centered is the same as the position in which the withdrawal means 120 operate for withdrawing the two segments 550*s*.

A further solution depicted in FIG. 4 provides that said centering device 350 is positioned in a central station between the anthropomorphic robot 200, comprising the cutting means 110 and the anthropomorphic robot 300, comprising the withdrawal means 120.

This solution makes it possible to increase the production rate of the apparatus 100, since the position in which pallet 500 is centered is a different position from the one in which the cutting means 110 or the withdrawal means 120 operate.

In all cases the centering step follows the cutting step and precedes the step of withdrawing the film 550 from the pallet 500.

As depicted in FIG. 4, preferably the centering device 350 comprises a lifting structure 180 and a movable frame 190.

The lifting structure 180 defines the load-bearing body of the centering device 350 and, as known to a person skilled in the art, can be made with a single upright as depicted in FIG. 4 or with a double upright.

The lifting structure 180 is also configured to accommodate the movable frame 190. In the case of a double-upright lifting structure 180, the movable frame 190 is inserted between the two uprights.

Said movable frame 190 is configured to translate vertically on said lifting structure 180.

Also in this case, the construction details of the lifting structure 180 and of the movable frame 190 will not be described herein as they are known to a person skilled in the art. The lifting structure 180 further preferably comprises vertical movement means such as for example motors, transmission elements, etc., for moving the movable frame 190 in a vertical direction.

In accordance with a feature of the present invention said frame 190 is ring-shaped, i.e. it comprises a structure 191 with four load-bearing sides 191*a*, each parallel to a side 502*a* of the pallet 500 and therefore configured to surround the pallet 500.

This shape allows the movable frame 190 to be operative over the entire height of the side surface 502, descending from the position above the pallet 500 until coming around the side surface 502.

Preferably, the movable frame 190 comprises four translating elements 192, parallel to the load-bearing sides 191*a*; said translating elements 192 are preferably movable on a plane orthogonal to the upward/downward direction of the movable frame 190.

In other words, the centering device 350, further comprises a lifting structure 180 and a frame 190 that is movable vertically on said structure 180, and said frame 190 comprising a structure 191 configured to surround the perimeter of the pallet 500 and on which preferably translating elements 192, preferably four, horizontally translate configured to approach or move away from a respective side 502*a* of the side surface 502 of the pallet 500.

Figure 6A:
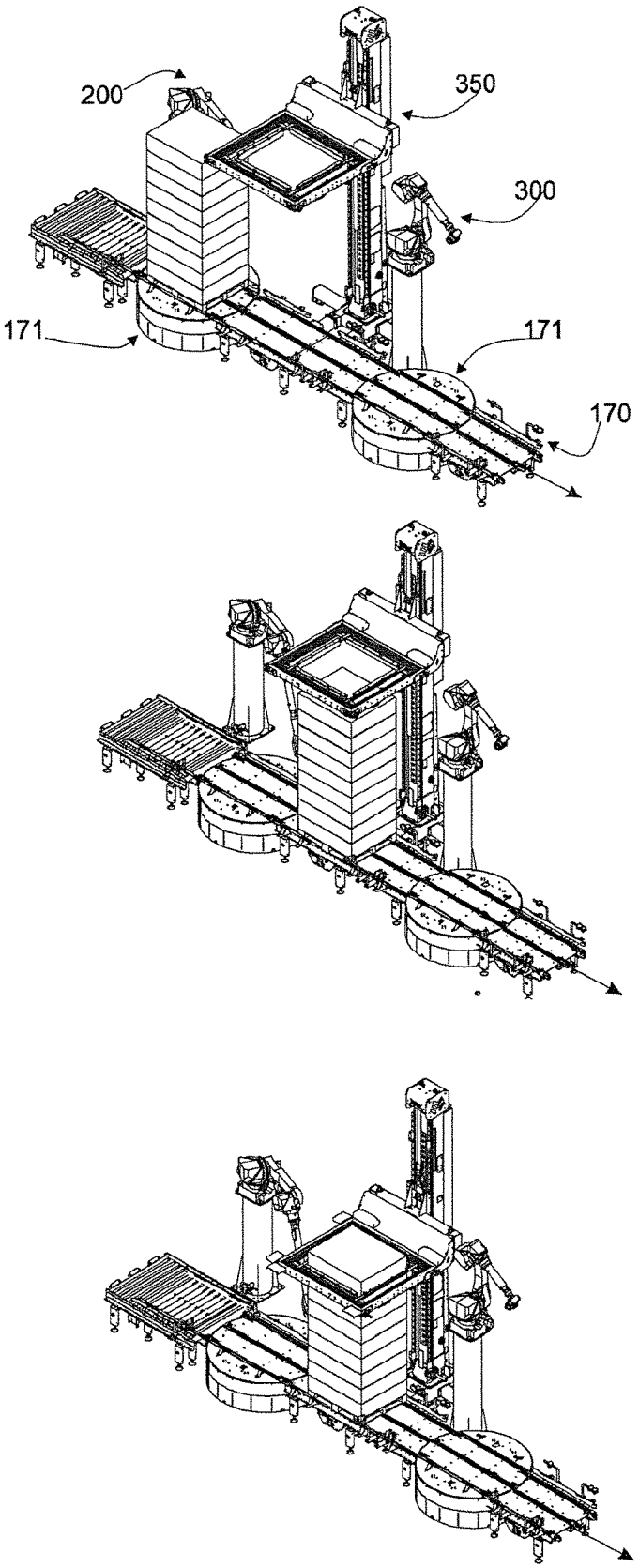
FIG. 6*a*, 6*b*: illustrates the sequence of the film centering and withdrawing steps.
Figure 6B:
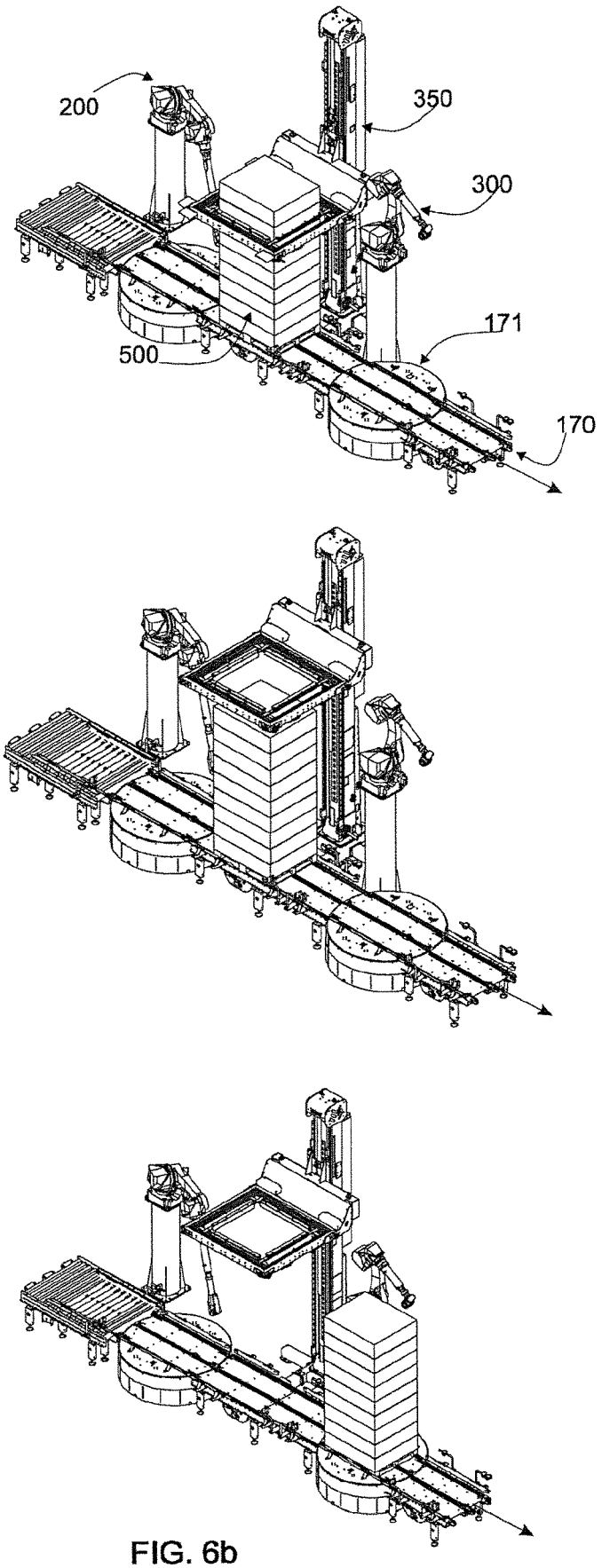

The configuration with four translating elements 192 is depicted in FIGS. 4, 6*a* and 6*b*.

An alternative solution can provide that the movable frame 190 of the centering device 350 is installed on an anthropomorphic robot.

Figure 8B:
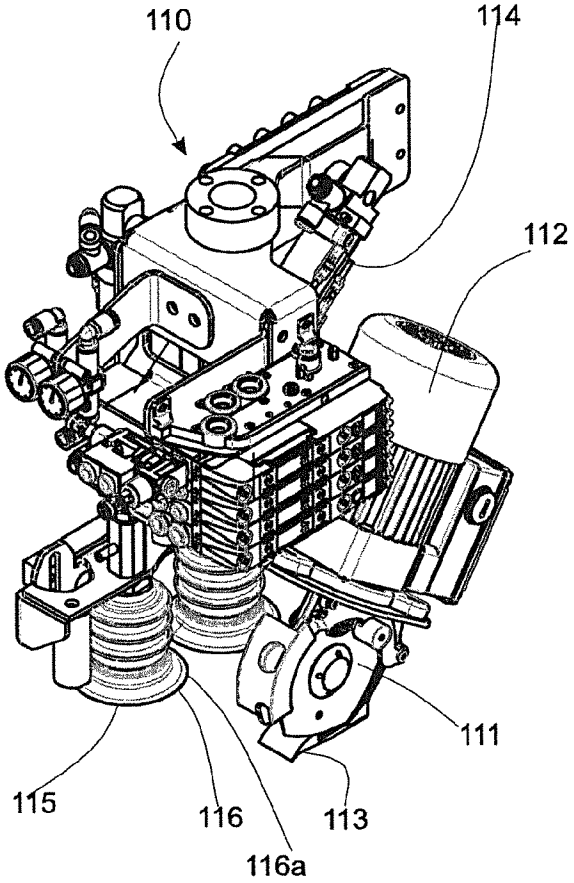
FIG. 8*a*, 8*b*: illustrates two axonometric views of the cutting device.
Figure 8A:
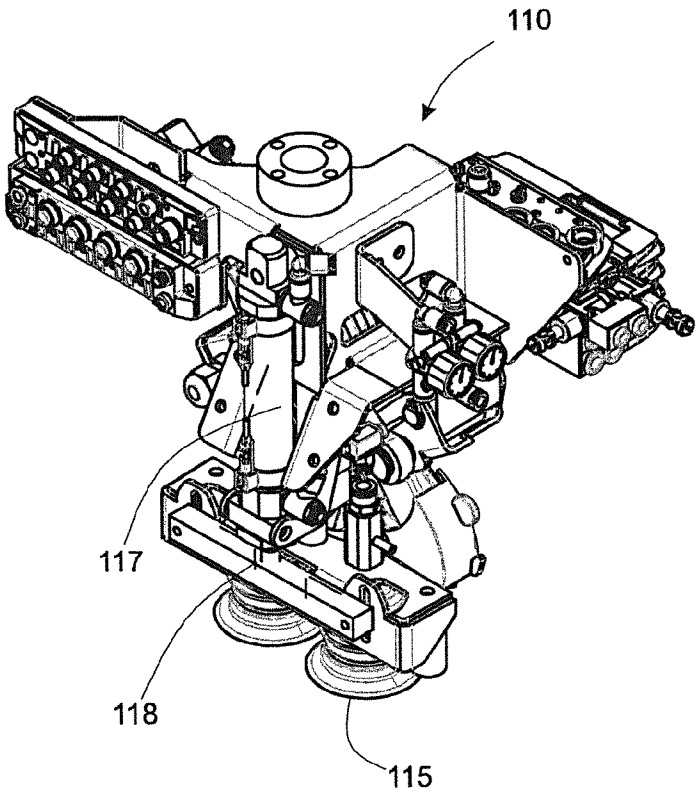
Figure 9B:
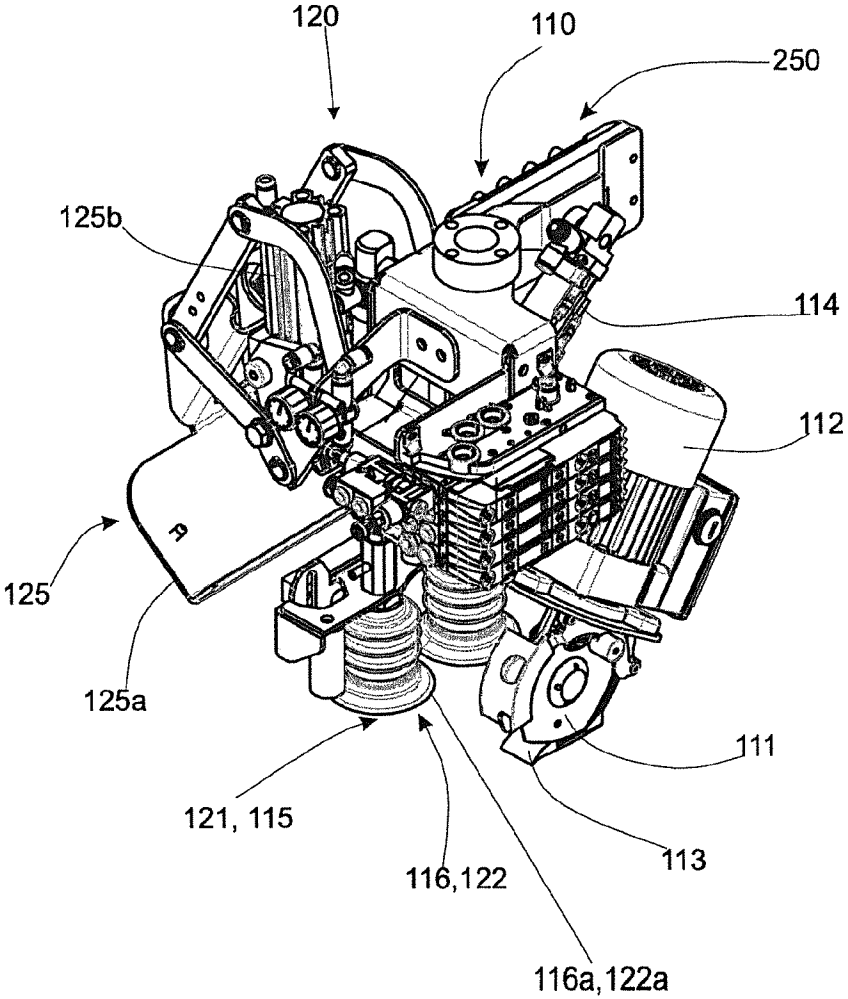
FIG. 9*a*, 9*b*: illustrates two axonometric views of the cutting device and withdrawal means installed on the same robot.
Figure 9A:
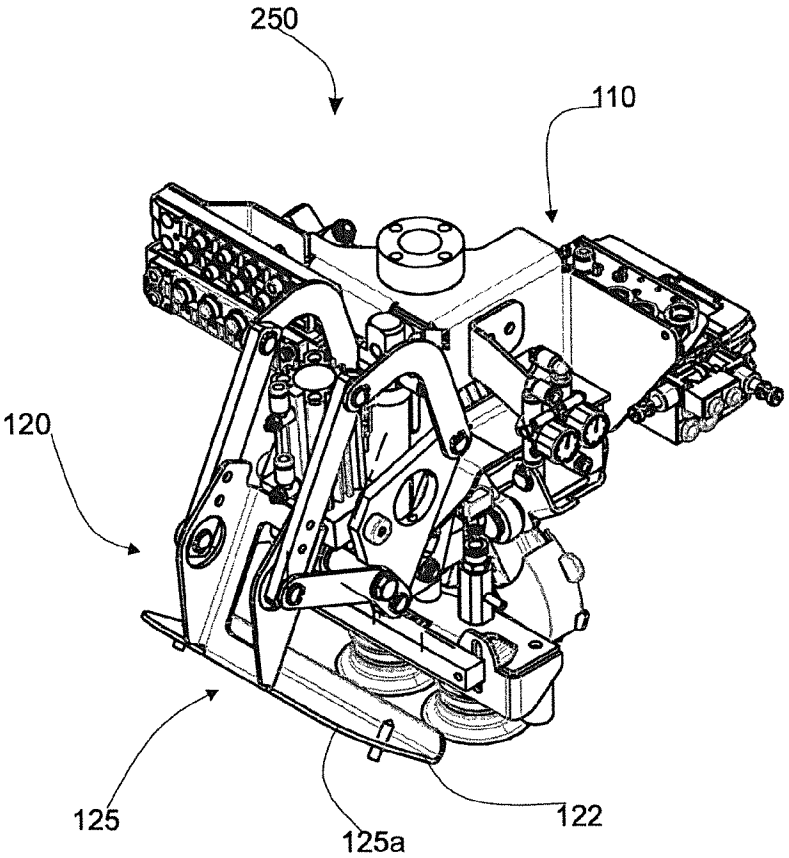

With regard to the cutting device 110, as depicted in FIGS. 8*a* and 8*b*, it preferably comprises a blade 111 and preferably means for actuating 112 said blade 111.

An advantageous aspect provides that said blade 111 is of the circular type, preferably rotatable.

Said blade 111 is rotated by means of actuating means 112.

Alternatively, a blade 111 having a different shape and/or not rotatable, but fixed, can also be used to implement the invention.

As depicted in FIGS. 8*a*, 8*b*, said cutting device 110 further preferably comprises adaptation elements 114 on which the blade 111 is installed to allow said blade 111 to adapt to any irregularities of the pallet 500 and/or of the protective film 550. As known to a person skilled in the art, said adaptation elements 114 may for example be of the tilting type, that is, hinged on a rotation fulcrum.

The adaptability can be given by gravity or by the presence of elastic or pneumatic or hydraulic elements.

According to an advantageous embodiment, the cutting device 110 comprises a protective element 113, which is configured to interpose between the product 510 and the film 550 to retain said film 550 near the blade 111. In particular, the purpose of the protective element 113 is to protect the product 510 from the possibility of being damaged by the blade 111, during the cutting steps.

Said method for undressing preferably provides, before starting the cut, to position said protective element 113 between the product 510 and the film 550, keeping said film 550 in contact with the blade 111.

Said protective element 113 is preferably placed near the blade 111.

Preferably said protective element 113 is preferably in a fixed position with respect to the blade 111 and is configured such that the blade 111 is embedded in the thickness of said protective element 113, preferably without protruding therefrom.

Therefore, in the case of the circular-type blade 111, the protective element 113 embraces a portion of the blade 111 so that it comes into contact with the film 550, but not with the product 510.

In particular, the cutting cycle provides that before starting the cut, the protective element 113 is inserted between the product 510 and the film 550.

Before carrying out the cut, the insertion of the protective element 113 between the film 550 and the product 510 can be carried out with the help of, for example, a load cell or by means of a torque control available on the anthropomorphic robot 200, as will be better described below.

In particular, to facilitate the insertion of the protective element 113, the method can provide for moving a portion of film 550 away from the side surface 502 of the pallet 500 before carrying out the cut.

Thanks to this solution, the initial cutting step is easier which reduces the possibility of contact with the palletized product 510.

In this way, by means of a load cell or by means of a torque control available on the anthropomorphic robot 200, it is possible to check the traction force of the film 550 during the movement away from the product 510, and when a set value is reached, for example within a predefined range, the insertion of the protective element 113 between the film 550 and the product 510 takes place and the cutting step can start.

Indeed, as depicted in FIGS. 8*a*, 8*b*, the cutting device 110 may comprise at least one detachment device 115.

According to a preferred aspect, said detachment device 115 comprises a suction head 116 configured to move a portion of film 550 away from the pallet 500 and assist in inserting the protective element 113.

Said suction head 116 can be installed on an adaptation device 117 preferably of the swiveling type adapted to allow to adapt the position of the suction head 116 to the shape of the surface of the pallet 500.

Said adaptation device 117 can be of the pneumatic type, as depicted in FIG. 8*a*, or of the electrical, mechanical type, etc.

Thanks to this configuration, the suction head 116 is suitable for operating even on surfaces of an irregular type.

In a particular configuration depicted in FIGS. 8*a*, 8*b*, the suction head 116 comprises one or more suction cups 116*a* adapted to move the film 550 away from the pallet 500 by means of vacuum.

FIG. 8*a* depicts a possible embodiment which provides a load cell 118 mechanically connected to the detachment device 115 and in particular interposed between the adaptation device 117 and the suction head 116.

Thus, when the suction head 116 activates the suction on the film 550, a force is generated which detaches the film 550 from the product 510. Said force is detected by the load cell 118 which verifies the magnitude of said traction force of the film 550.

Depending on the position assumed by the robot 200 during the detachment and in the event that the load cell 118 detects that a set force value has been reached, or that it falls within a predefined range, the insertion of the protective element 113 between the film 550 and the product 510 may take place.

As soon as the protective element 113 has been inserted between the product 510 and the film 550, the blade 111 starts cutting.

Preferably, the first or second section 562*t*1 562*t*2 is made starting from the first cut 561*t* already carried out near the base 520 and preferably in the central area of the respective side 502*a*, i.e. where the film 500 is less taut and easier to distance from the pallet 500.

This facilitates the insertion of the protective element 113 between the product 510 and the film 550.

Moreover, thanks to the insertion of the protective element 113, the blade 111 can start the first section 562*t*1 and can continue to perform the first upper section 563*t*1 passing from the side portion 552 to the upper portion 551 of the film 550, without interrupting the execution of the cut and always keeping the protective element 113 inserted between the product 510 and the film 550.

Thanks to said protective element 113, the passage between the second cut 562*t* and the third cut 563*t* takes place gradually between the end of the vertical cut on the side portion 552 and the beginning of the horizontal cut on the upper portion 551, adapting itself according to the resistance that the film 550 opposes and so that the film 550 remains retained between the blade 111 and the protective element 113, also in this step of passage.

Thanks to this solution the blade 111 is able to cut continuously during all the cutting steps, without losing the film 550 and furthermore the blade 111 does not come into contact with the product 510 avoiding any risk of damage.

The apparatus 100, further comprises the withdrawal means 120 configured to move the protective film 550 away from the pallet 500, withdrawing each segment 550*s*.

Advantageously, in order to improve the retention of the film 550, the withdrawal means 120 withdraw the segment 550*s* near the second cut 562*t*.

Figure 7:
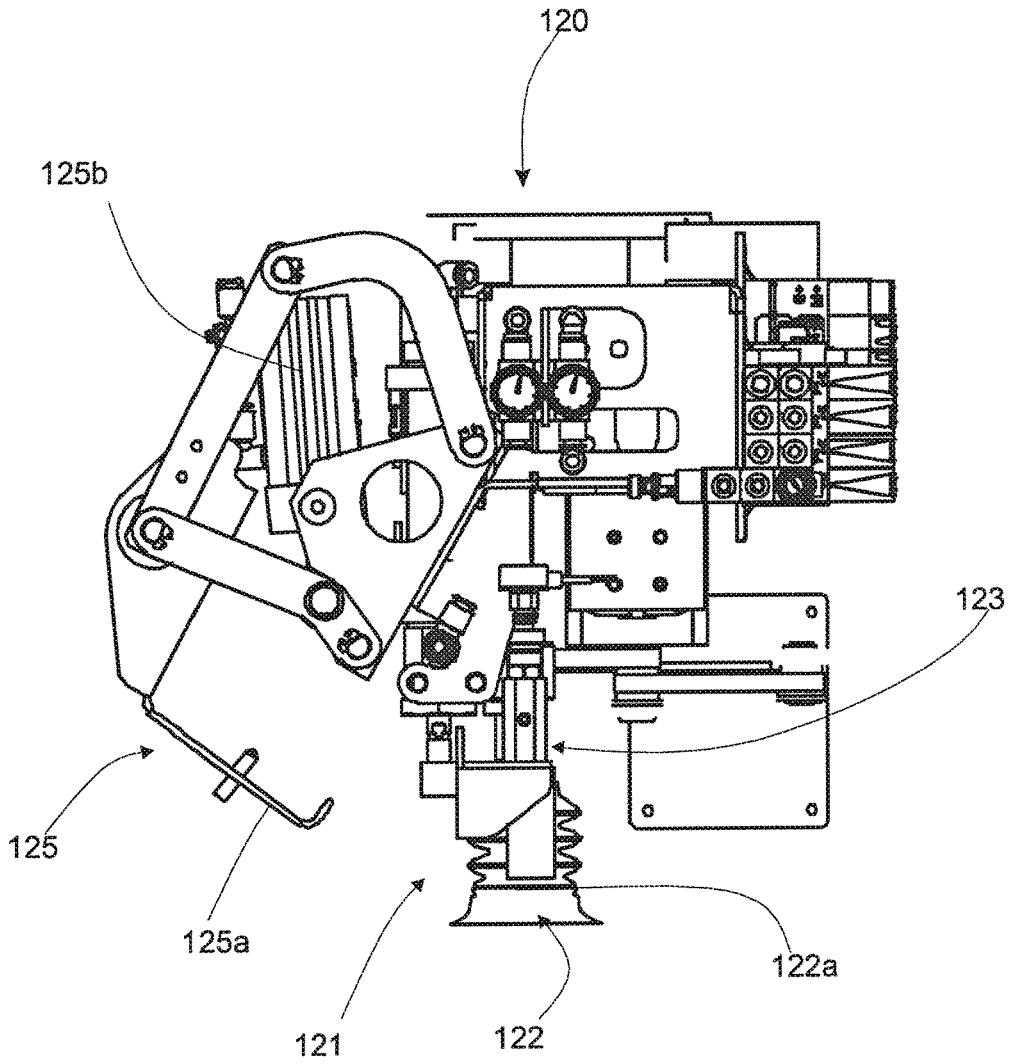
FIG. 7: illustrates a top view of the robot with withdrawal means.

According to one aspect of the invention, depicted in FIG. 7, the withdrawal means 120 comprise at least one gripping device 121.

According to a preferred aspect said withdrawal means 120 are also configured to release said segment 550*s* to at least one evacuation device 130 which will be described in detail below.

In particular, said gripping device 121 comprises a grasping head 122 configured to move away and/or retain the segment 550*s* from the pallet 500.

Said grasping head 122 may be installed on an adapter 123, preferably of the swiveling type adapted to allow to adapt the position of the grasping head 122 to the shape of the surface of the pallet 500.

Said adapter 123 can be of the pneumatic type, as depicted in FIG. 7, or of the electrical, mechanical type, etc.

Thanks to this configuration, the grasping head 122 is suitable for operating even on surfaces of an irregular type.

In a particular configuration depicted in FIG. 7, the grasping head 122 is configured to lift and retain the film 550 by means of vacuum and preferably comprises at least one suction element 122*a*.

The withdrawal means 120 may further comprise at least one locking device 125 adapted to securely retain a flap of the cut segment 550*s* that has been previously moved away from the pallet 500 by means of the gripping device 121.

Preferably said flap of film 550 on which the locking device 125 operates is at the second cut 562*t*.

Said locking device 125 is shaped so as to have a locking capacity higher than the grasping head 122 so as to guarantee the retention of the film 550 during the whole step of movement away from the pallet 500.

In fact, the suction elements 122*a* allow the segment 550*s* to be moved away but are not able to guarantee retention, if for example the film 550 is damaged or dirty.

FIG. 7 depicts an example of a possible locking device 125 comprising a tab 125*a*. Said tab 125*a* is preferably movable by means of activation means 125*b* between at least one operating position and one outside the space. Said activation means 125*b* can be of the pneumatic type, as depicted in FIG. 7, or of the electrical, mechanical type, etc.

A preferred embodiment provides that when the tab 125*a* is in the operating position, it is positioned below the grasping head 122. Thus, the flap of film 550 remains retained between the grasping head 122 and the tab 125*a*.

In the case where the apparatus 100 comprises a single anthropomorphic robot 200, the withdrawal means 120 and the cutting device are integrated into a single head 250.

A preferred embodiment provides that in this case the detachment device 115 and the gripping device 121 coincide and perform both functions:

- moving the film 550 away from the pallet 500 before cutting to facilitate the insertion of the protective element 113,
- moving away and retaining the segment 550*s* from the pallet 500 for its undressing.

It is understood however that what is described above has a value of non-limiting example, therefore, possible variants of detail that may be necessary for technical and/or functional reasons, are considered from now on as falling within the same scope of protection.

After the cut of the film 550 has been carried out according to the embodiments described above, the film 550 is withdrawn from the pallet 500 by means of the withdrawal means 120 and brought to the evacuation device 130.

A feature of the invention provides that said evacuation device 130 comprises shredding means that are configured to cut/shred the film 550 of each segment 550*s* into small portions prior to their evacuation.

In summary, the method for undressing a pallet 500 coated with a protective film 550 preferably provides for said protective film 550 into at least two segments 550*s* each comprising an upper flap 551*s* of an upper portion 551 of film 550 at the upper surface 501 of the pallet 500 and a lower flap 552*s* of a side portion 552 of film 550 at the side surface 502 of the pallet 500.

In particular, the method provides for moving said segments 550*s* away from the pallet 500.

Preferably, the steps of separating by cutting and moving said segment 550*s* away from the pallet 500 take place in sequence.

An example of a working cycle envisages bringing the pallet 500 to be undressed into a working position within the apparatus 100 and preferably within the work area of the first anthropomorphic robot 200.

The cutting device 110 approaches the side portion 552 of the film 550 and by means of the detachment device 115 the film 550 is moved away from the pallet 500.

At this point, the protective element 113 is interposed between the product 510 and the film 550; the blade 111 starts carrying out the first cut 561*t*.

In particular, as depicted in FIG. 5*a*, the first portion 561*t*1 and the second portion 561*t*2 of the first cut 561*t* are carried out.

Therefore preferably the cutting means 110 carry out the first section 562*t*1, and preferably continue without interruptions to carry out the first upper section 563*t*1.

According to a preferred embodiment, the pallet 500 is rotated around a vertical symmetry axis Z thereof by 180° and the third portion 561*t*3 and the fourth portion 561*t*4 are performed on the remaining two successive sides 502*a*.

At this point the cutting means 110 carry out the second section 562*t*2, and preferably continue without interruptions to carry out the second upper section 563*t*2.

The cutting sequence may be as described above, but also in reverse, as depicted in FIG. 5*b*, initially the first section 562*t*1 of the second cut 562*t*, and preferably the first upper section 563*t*1 of the third cut 553 and then the first portion 561*t*1 and the second portion 561*t*2 of the first cut 561*t* may be carried out.

After rotating the pallet 500 around a vertical symmetry axis Z thereof by 180°, the second section 562*t*2, and preferably the second upper section 563*t*2, are performed.

At this point, the cutting means 110 carry out the third portion 561*t*3 and the fourth portion 561*t*4 of the first cut 561*t*, on the remaining two successive sides 502°.

Once the cutting step has been finished and the two segments 550*s* have been made, the cycle provides for performing a step of centering, preferably the upper layers of the pallet 500.

If the apparatus 100 comprises only a first anthropomorphic robot 200, the cycle continues with the intervention of the withdrawal means 120 which move the segments 550*s* away from the pallet 500 and release them to the evacuation devices 130.

Alternatively, if the apparatus 100 comprises a second anthropomorphic robot 300, the pallet 500 is transferred to a working position within the work area of the second anthropomorphic robot 300.

Preferably the centering step is carried out in an intermediate position between the first robot 200 and the second robot 300.

Said second anthropomorphic robot 300, by means of the withdrawal means 120, moves the segments 550*s* away from the pallet 500 and releases them to the evacuation devices 130.

In particular, the withdrawal means 120 move a flap of the segment 550*s* away from the pallet 500, preferably at the second cut 562*t*, by means of the gripping device 121 and lock it by means of the locking device 125.

Subsequently the evacuation devices 130 perform the cutting/shredding of the segments 550*s*.

A preferred embodiment of said undressing method can also provide a first step of checking the outline of the pallet 500. Said check can be carried out by means of a portal with sensors configured to carry out measurement checks, or for example a 3D camera.

In this way the geometry of the pallet 500 is verified, for example the inclination with respect to a symmetry axis Z thereof.

This makes it possible to select the pallets 500 that can be processed from those outside the outline that cannot be subjected to automatic undressing by means of the 100 apparatus.

It is understood however that what is described above has a value of non-limiting example; therefore possible detail variants that may be required for technical and/or functional reasons are considered from now as falling within the same scope of protection defined by the claims reported below.

A different embodiment of the apparatus 100' is reported below.

Figure 13:
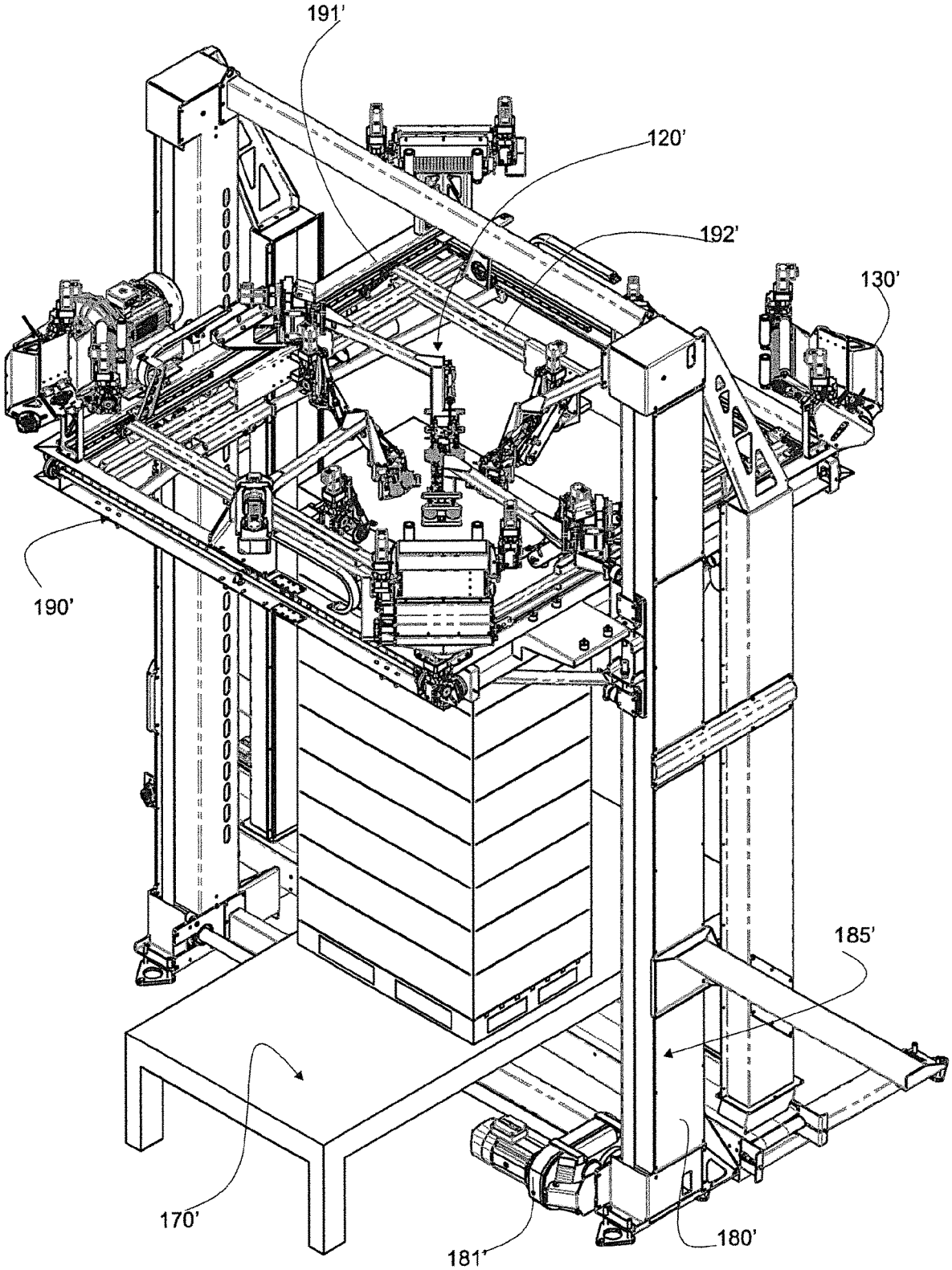
FIG. 13: illustrates an axonometric view of an apparatus for undressing pallets according to the invention.

With particular reference to FIG. 13, an apparatus 100' for undressing a pallet 500 of products 510, preferably arranged in layers on a base or plate 520, is depicted.

Said pallet 500 is coated with a protective film 550 for retaining and protecting the products 510 themselves.

Figure 11:
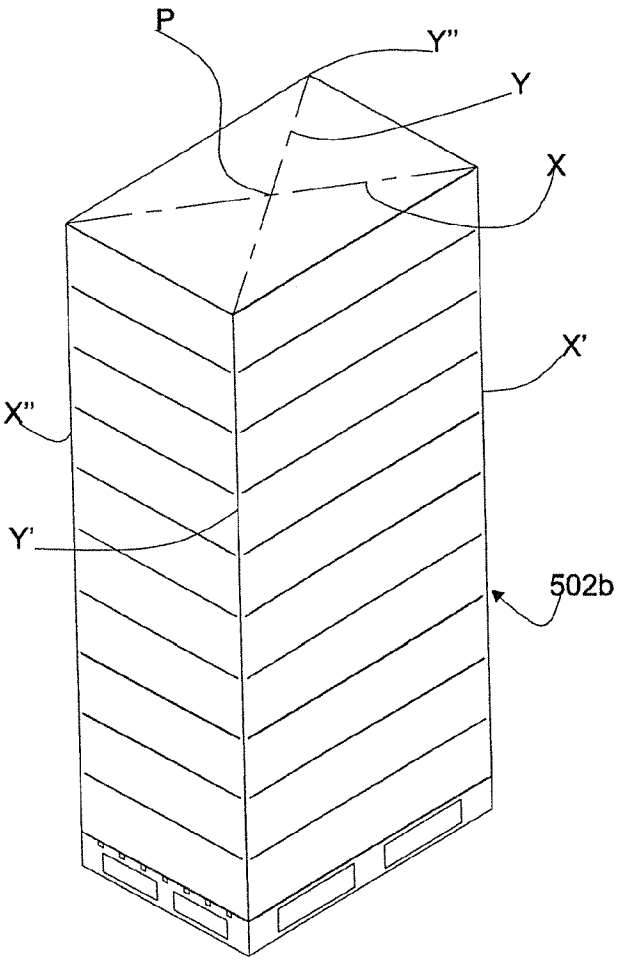
FIG. 11: illustrates a pallet with cuts in a different possible embodiment.
Figure 10:
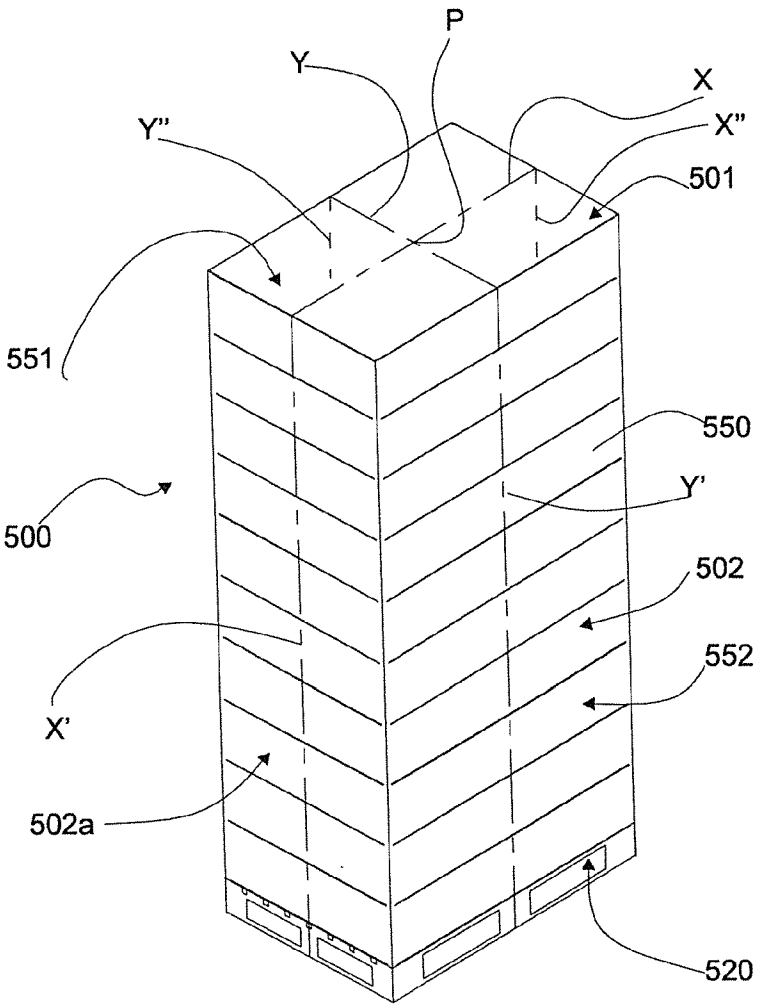
FIG. 10: illustrates a pallet with cuts in a different possible embodiment.

The protective film 550 therefore comprises an upper portion 551 at the upper surface 501 of the pallet 500 and a side portion 552 at the side surface 502 of the pallet 500. As depicted in FIGS. 10, 11, the side portion 552 extends on all four sides 502*a* of the side surface 502 of the pallet 500. Likewise in FIGS. 10, 11, the four edges 502*b* of the side surface 502 are identified.

In particular, said apparatus 100' comprises cutting devices 110' for cutting the protective film 550 on the pallet 500 and preferably withdrawal means 120' for withdrawing the protective film 550 from the pallet 500, once it has been cut.

Said cutting means 110' cut the film 550 defining and separating portions of said film 550.

According to one aspect of the invention, said cutting devices 110' are configured to separate said protective film 550 into at least two segments 550*s*.

The term "segment" means a portion of protective film 550 separated from the remaining film 550 by cutting. More precisely, according to a preferred embodiment, each segment 550*s* comprises an upper flap 551*s* of the upper portion 551 of film 550 and a lower flap 552*s* of the side portion 552 of film 550.

Advantageously, each segment 550*s* is moved away from the pallet 500 by means of the withdrawal means 120'.

In accordance with an aspect of the invention, the cutting devices 110' are configured to separate at least one upper flap 551*s* of the segment 550*s* by performing a first horizontal cut X on the upper portion 551 of film 550 extending from one side 502*a* of the side surface 502 to the respective symmetrically opposite side 502*a*.

Alternatively said first horizontal cut X may extend from an edge 502*b*, of the side surface 502 to the respective diagonally opposite edge 502*b*.

In accordance with a further aspect of the invention, the cutting devices 110' are configured to separate the lower flap 552*s* of the segment 550*s* by performing on the side portion 552 of the film 550 a first and a second vertical cut X', X" which are preferably the continuation, of the ends of the first horizontal cut X along the corresponding side 502*a* or the corresponding edge 502*b* of the side surface 502.

Said first and second vertical cut X', X" stretch from the first horizontal cut X preferably throughout the entire height of the pallet 500.

Said first and second vertical cut X', X" are preferably made in the vertical direction of the ends of the first horizontal cut X as depicted in FIGS. 10, 11.

It is to be understood that any alternatives in which said first and second vertical cut X', X" are made from the top downwards in an inclined direction are also to be considered from now on as falling within the same scope of protection.

In one embodiment of the present invention, the cutting devices 110' are adapted to separate a plurality of segments 550*s*, preferably four in number.

A first embodiment provides for making the four segments 550*s*, by means of said cutting devices 110' which are further configured to separate at least the upper flap 551*s* by performing, on the upper portion 551 of film 550 in addition to the first horizontal cut X, at least a second horizontal cut Y intersecting each other at a first point of intersection P.

Said second horizontal cut Y preferably extends from a side 502*a*, of the side surface 502 to the respective symmetrically opposite side 502*a*.

Alternatively, said second horizontal cut Y may extend from an edge 502*b*, of the side surface 502 to the respective diagonally opposite edge 502*b*.

Further preferably, the cutting devices 110' are configured to separate the lower flap 552*s* of the segment 550*s* by performing, on the side portion 552 of the film 550 in addition to the first and second vertical cut X', X" described above, also a third and fourth vertical cut Y', Y".

Said third and fourth vertical cut Y', Y" are preferably the continuation, respectively, of the second horizontal cut Y along the corresponding side 502*a* or the corresponding edge 502*b* of the side surface 502.

Said third and fourth vertical cut Y', Y" stretch from the second horizontal cut Y preferably throughout the entire height of the pallet 500.

Said third and fourth vertical cut Y', Y" are preferably made in the vertical direction of the ends of the second horizontal cut Y as depicted in FIGS. 10, 11.

It is to be understood that any alternatives in which said third and fourth vertical cut Y', Y" are made from the top downwards in an inclined direction are also to be considered from now on as falling within the same scope of protection.

A second embodiment provides for making the four segments 550*s*, by means of said cutting devices 110' which are configured to separate the upper flaps 551*s* by performing, on the upper portion 551 of film 550, a first pair of cuts X1, Y1 intersecting each other at a first point of intersection P1.

Said first point of intersection P1 is preferably located in a central area of the upper surface 501.

Each cut of said first pair of cuts X1, Y1 extends from said first point of intersection P1 up to the two adjacent sides 502*a* or alternatively up to the two adjacent edges 502*b* of the side surface 502.

Said cutting devices 110' are configured to perform a second pair of horizontal cuts X2, Y2 intersecting each other at a second point of intersection P2.

Said second point of intersection P2 is preferably located in a central area of the upper surface 501.

Each cut of said second pair of horizontal cuts X2, Y2 extends from said second point of intersection P2 up to the two adjacent sides 502*a* or alternatively up to the two adjacent edges 502*b*.

In particular said two sides 502*a* or two edges 502*b* are opposite to those of the first pair of horizontal cuts X1, Y1.

A preferred embodiment provides that the cutting devices 110 are configured to perform said first pair of cuts X1, Y1 and said second pair of horizontal cuts X2, Y2 such that the cuts of each pair are orthogonal to each other.

In particular, since most of the pallets 500 are rectangular in shape, this configuration is possible when the first pair X1 and Y1 and the second pair of horizontal cuts X2, Y2 extend up to the sides 502*a* and not to the edges 502*b*.

Preferably said pair of cuts X1, Y1 and said second pair of horizontal cuts X2, Y2 provides that both cuts are parallel to the respective sides of the upper surface 501.

This configuration simplifies the mechanical realization of the cutting devices 110'.

In accordance with possible embodiments the cutting devices 110' are configured to perform said first pair of horizontal cuts X1, Y1 and second pair of horizontal cuts X2, Y2 so that said first and second points of intersection P1, P2 are placed in the central area of the upper surface 501 and preferably in such a position as to ensure that both cuts of the first pair of horizontal cuts X1, Y1 intersect both cuts of the second pair of horizontal cuts X2, Y2.

Thanks to this aspect, the complete separation of the upper flaps 551*s* from each other is guaranteed, ensuring that no uncut areas are left, which have to be forcibly separated by tearing.

An advantageous sequence for making the first pair of horizontal cuts X1, Y1 and the second pair of horizontal cuts X2, Y2 provides that the cutting devices 110 first make the two cuts X1 and X2 and then the cuts Y1 and Y2.

A preferred aspect provides for separating with the cutting devices 110' further lower flaps 552*s* by performing on the side portion 552 of the film 550 a first pair of vertical cuts X1', Y1' and a second pair of vertical cuts X2', Y2' which are the continuation, respectively, of the first pair of horizontal cuts X1, Y1 and of the second pair of horizontal cuts X2, Y2 along the corresponding side 502*a* or the corresponding edge 502*b* of the side surface 502 preferably throughout the entire height of the pallet 500.

Figure 12B:
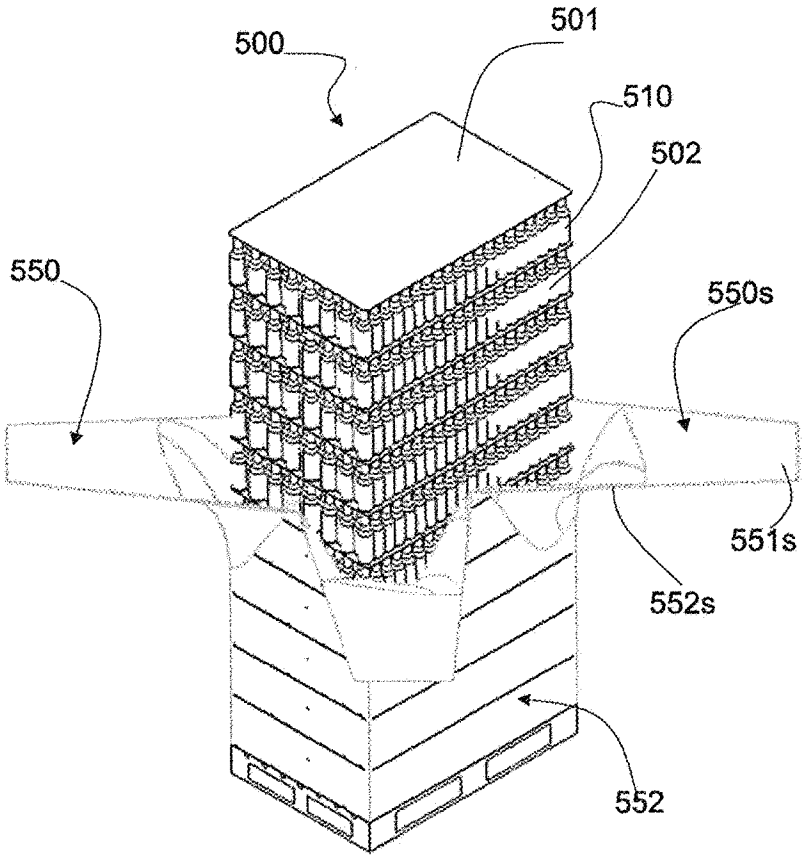
FIG. 12*a* 12*b*: illustrates a pallet with cuts according to a further embodiment and related subdivision into segments.
Figure 12A:
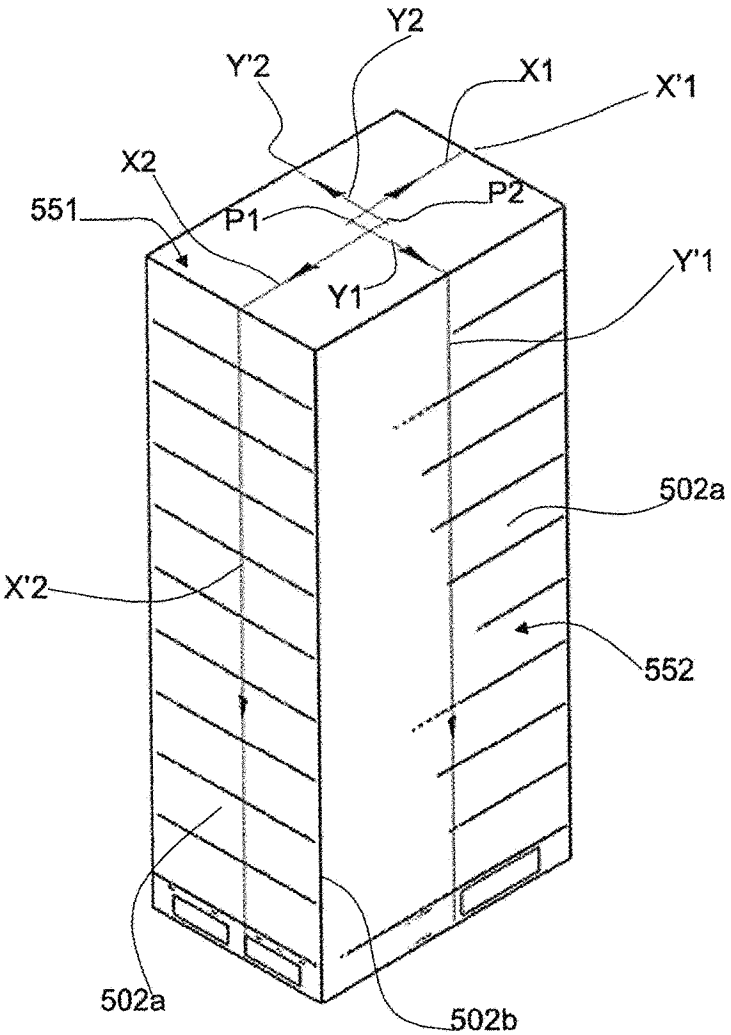

Said first and second pair of vertical cuts X1', Y1' and X2', Y2' are preferably made in the vertical direction from the ends of the first and second horizontal pair X1, Y1 and X2, Y2 as depicted in FIG. 12*a*.

Advantageously, the realization of the first and second pair of vertical cuts X1', Y1' and X2', Y2' provides that the cutting devices 110' make the vertical cuts simultaneously.

It is to be understood that any alternatives in which the said first and second pair of vertical cuts X1', Y1' and X2', Y2' are made from the top downwards in an inclined direction, are also to be considered from now on as falling within the same scope of protection.

Figure 25B:
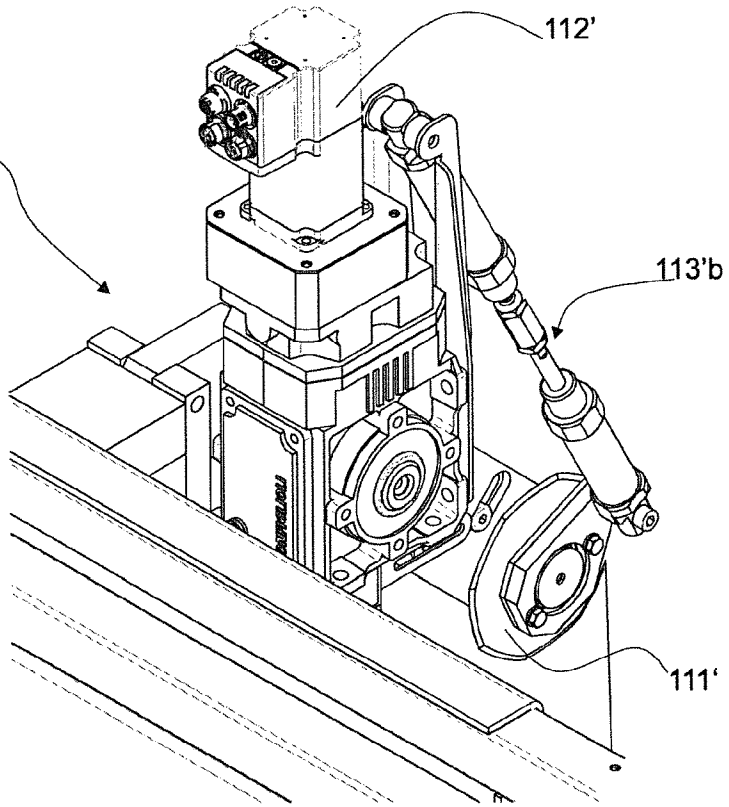
FIG. 25*a*, 25*b*, 25*c*: illustrates a side and axonometric view of the cutting devices and related working steps.
Figure 25A:
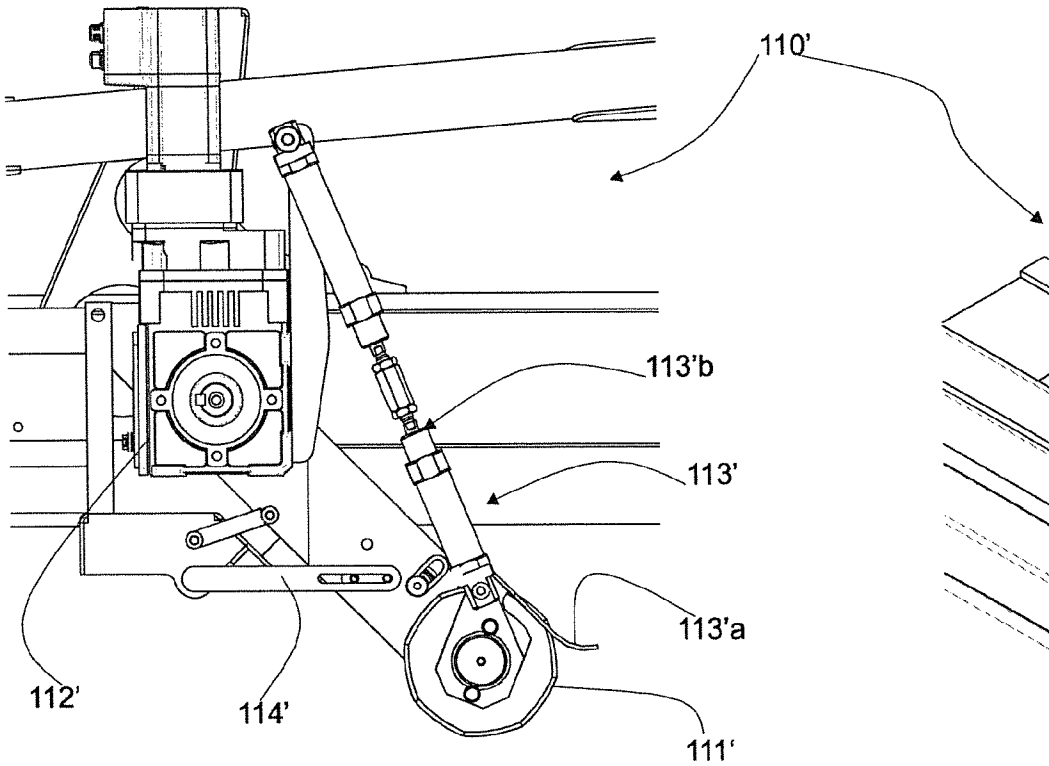
Figure 25C:
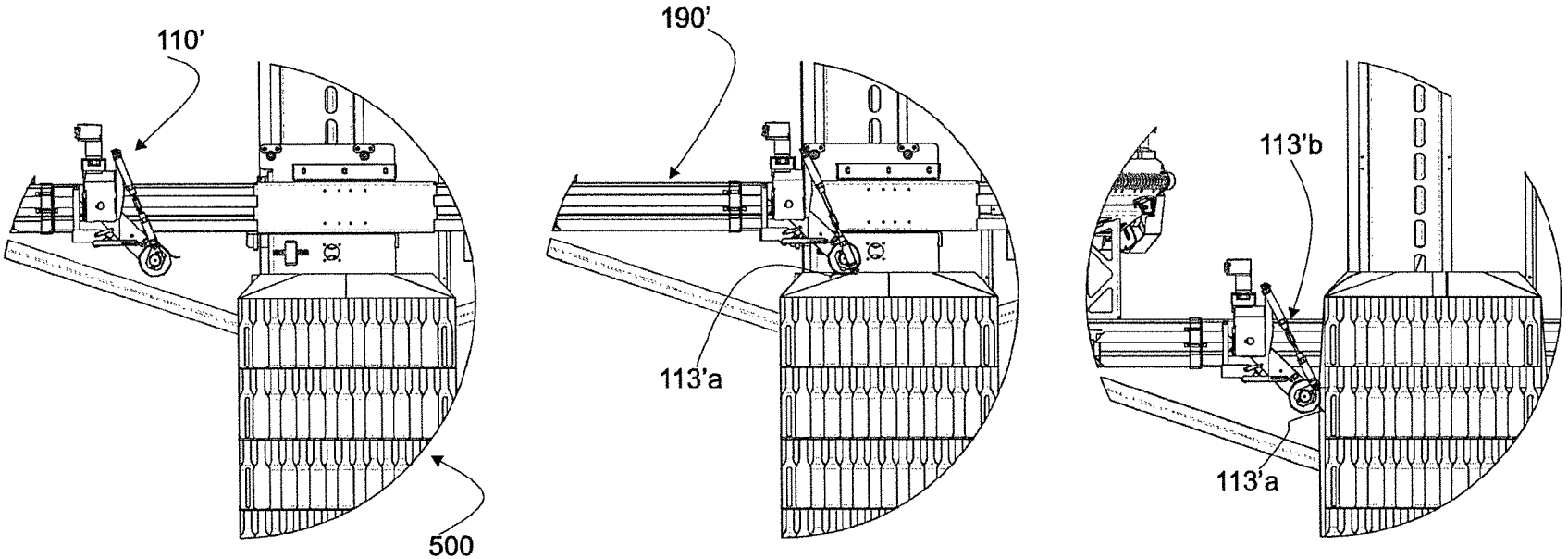

Said cutting devices 110' as depicted in FIGS. 25*a*, 25*b*, preferably comprise a blade 111' and preferably means 112' for actuating said blade 111'.

An advantageous aspect provides that said blade 111' is of the circular type, preferably rotatable. Said blade 111' is rotated by means of actuating means 112'. Alternatively, a blade 111' having a different shape and/or not rotatable, but fixed, can also be used to implement the invention.

As depicted in FIGS. 25*a*, 25*b*, said cutting devices 110' further preferably comprise adaptation elements 114' on which the blade 111 is installed to allow said blade 111' to adapt to any irregularities of the pallet 500 and/or of the protective film 550. As known to a person skilled in the art, said adaptation elements 114' may for example be of the tilting type, that is, hinged on a rotation fulcrum.

The adaptability can be given by gravity or by the presence of elastic or pneumatic or hydraulic elements.

According to an advantageous embodiment, the cutting devices 110' comprise retaining means 113', which are configured to interpose between the product 510 and the film 550 to retain said film 550 near the blade 111'. In particular, their purpose is to protect the product 510 from the possibility of being damaged by the blade 111', during the cutting steps.

Said retaining means 113' comprise a rest element 113'*a* placed near the blade 111' and preferably tangential to the diameter of the circular-type blade 111'.

Further preferably, the retaining means 113' comprise activation means 113'*b* which, as depicted in FIGS. 25*a*, 25*b*, are configured to displace the rest element 113'*a* with respect to the blade 111' by positioning said rest element 113'*a* between the product 510 and the film 550 during cutting.

In particular, they are configured to make the rest element 113'*a* assume, for example, 3 positions: an out-of-space position before starting the cutting of the film 550, a first working position suitable for horizontal cutting and a second working position suitable for vertical cutting.

Further preferably the activation means 113'*b* are configured to rotate said rest element 113'*a* around the circular type blade 111'.

Said activation means 113'*b* can comprise actuators of the electric, pneumatic or hydraulic type.

In particular, the cutting cycle envisages that, before starting the cut, the rest element 113'*a* is in the out-of-space position; as soon as the blade 111' starts the horizontal cut, the activation means 113'*b* bring the rest element 113'*a* into the first working position, i.e. below the cut film 550. This allows to retain said film 550 between the blade 111' and the rest element 113'*a*. Once the horizontal cut is finished, the activation means 113'*b* bring the rest element 113'*a* into the second working position, that is suitable for the vertical cut.

The passage from the first horizontal cutting position to the second vertical cutting position takes place gradually between the end of the horizontal cut and the beginning of the vertical cut, adapting according to the resistance that the film 550 opposes and in such a way that the film 550 remains between the blade 111' and the rest element 113'*a* even in this step of passage.

Thanks to this solution the blade is able to cut continuously during all the cutting steps, without losing the film 550 and further the blade 111' does not come into contact with the product 510 avoiding any risk of damage.

FIGS. 13 to 23 depict a preferred configuration in which the cutting devices 110' are four in number, i.e. one on each side of the pallet 500.

This allows a high productivity of the apparatus 100', speeding up the cutting step. In particular, this configuration is advantageous for example for making the first pair of cuts X1, Y1 and the second pair of horizontal cuts X2, Y2.

In fact, the four cutting devices 110' allow to perform the first pair of cuts X1, Y1 and the second pair of horizontal cuts X2, Y2 according to the advantageous sequence which provides for first making the two cuts X1 and X2 and then the cuts Y1 and Y2.

Furthermore, said configuration with the four cutting devices 110' also allows the simultaneous realization of the first and second pair of vertical cuts X1', Y1' and X2', Y2'.

The apparatus 100', further comprises the withdrawal means 120' configured to move the protective film 550 away from the pallet 500, withdrawing each segment 550*s*.

In particular, said withdrawal means 120' are configured to withdraw the upper flap 551*s* carrying it away from the upper surface 501 of the pallet 500.

Advantageously, in order to improve the retention of the film 550, the withdrawal means 120' withdraw the upper flap 551*s*, near the points of intersection P, P1, P2.

Figure 24A:
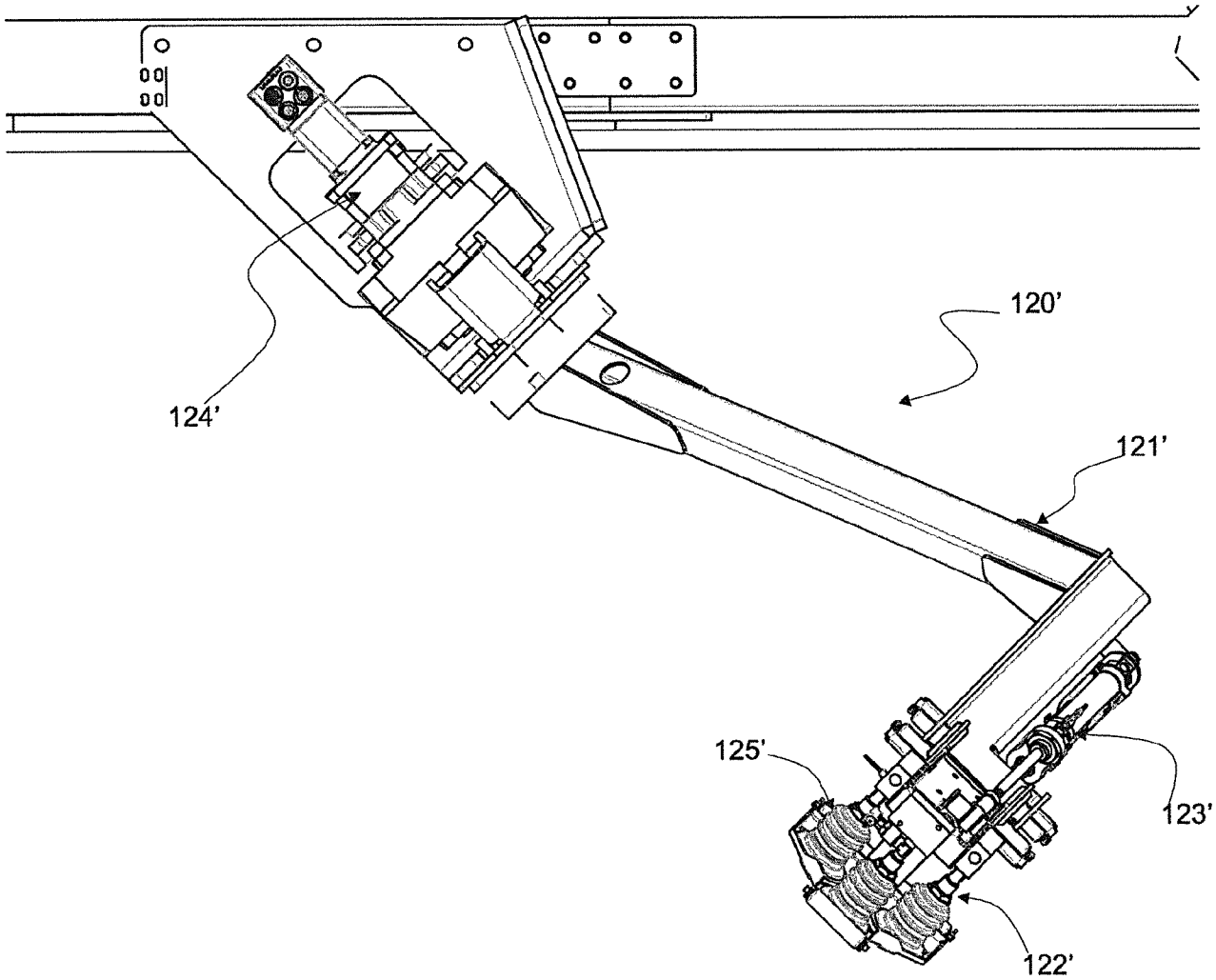
FIG. 24*a*, 24*b*: illustrates an axonometric view from above of the withdrawal means and related working positions.

According to one aspect of the invention, depicted in FIG. 24*a*, the withdrawal means 120' comprise at least one gripping device 121' and preferably one gripping device 121' for each segment 550*s* to be withdrawn.

According to a preferred aspect said withdrawal means 120' are also configured to release said upper flap 551*s* to at least one evacuation device 130' which will be described in detail below.

In particular, said gripping device 121' comprises a grasping head 122' configured to lift and retain the film 550 and movement means 124' configured to bring said head 122' from the withdrawal position of the film 550 on the upper surface 501 to the release position at the respective evacuation device 130'.

Figure 24B:
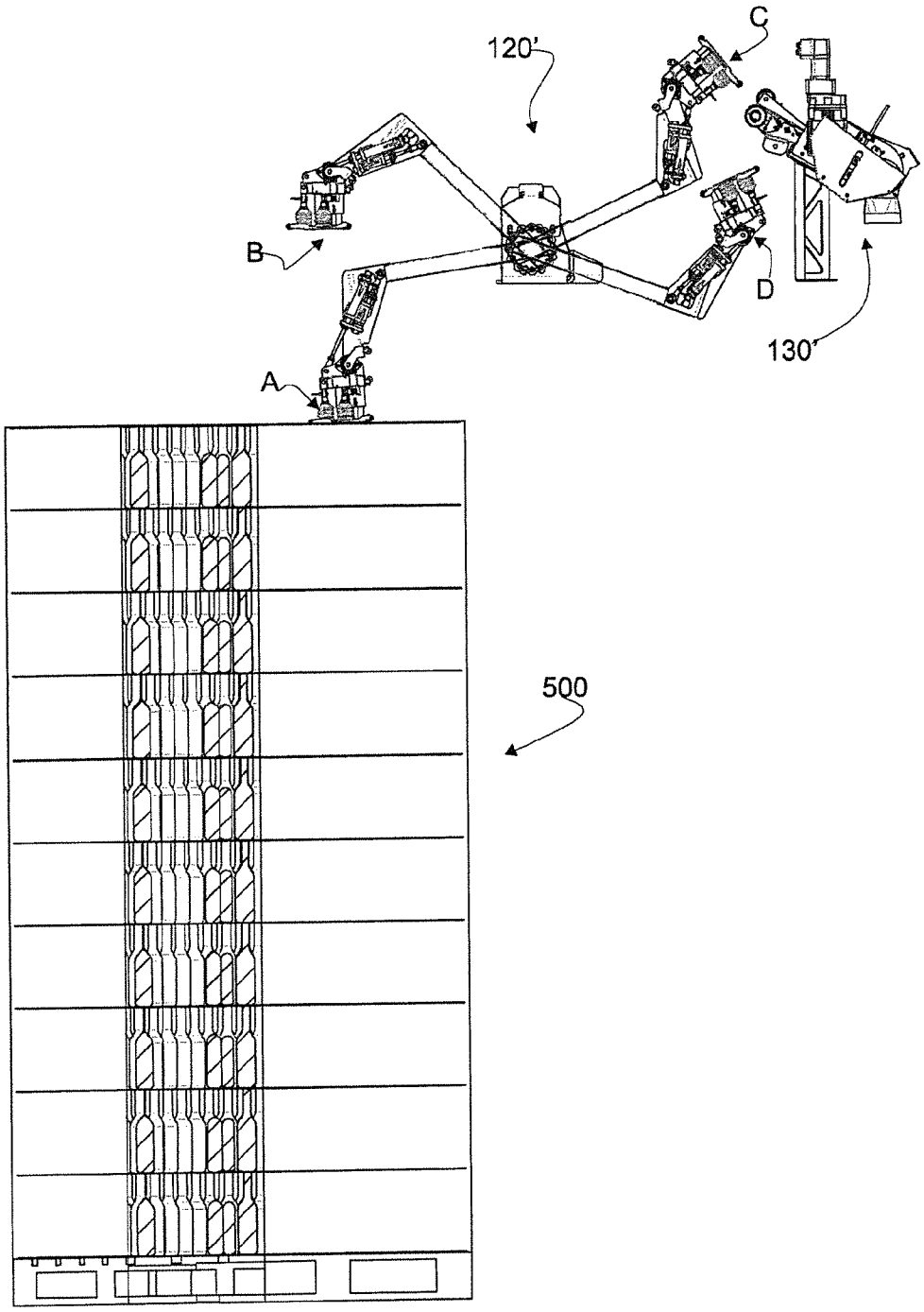

FIG. 24*b* depicts four significant positions that can be assumed by the gripping device 121' during the working cycle.

In particular:

- position A represents the position of the gripping device 121' when it withdraws the film 550 from the upper surface 501;
- position B represents the position of the gripping device 121' furthest away from the pallet 500;
- position C represents the position of the gripping device 121' when it releases the film 550 to the evacuation devices 130';
- position D represents the position of the gripping device 121' when it moves outside the space while awaiting a new working cycle.

Preferably, the head 122' moves from the film withdrawal position 550, on the upper surface 501, to the release position by rotation about a horizontal axis of rotation.

Said grasping head 122' may be installed on an adapter 123', preferably of the swiveling type adapted to allow to adapt the position of the grasping head 122' to the shape of the upper surface 501 of the pallet 500.

Thanks to this configuration, the grasping head 122' is suitable for operating even on surfaces of an irregular type.

Furthermore, the adapter 123' is also adapted to allow reaching all the positions that the grasping head 122' must reach during the working step and which have been described previously.

In a particular configuration depicted in FIG. 24*a*, the grasping head 122' is configured to lift and retain the film 550 by means of vacuum and preferably comprises at least one suction element 125'.

Said withdrawal means 120' may also be advantageously used to retain and move the upper portion 551 of the film 550 away from the upper surface 501 before cutting the film 550. In fact, this away-movement makes the step of starting the cut with the blade 111' easier.

As depicted in FIG. 13, preferably the apparatus 100' comprises a lifting structure 180' and a movable frame 190'.

The lifting structure 180' defines the load-bearing body of the machine and, as known to a person skilled in the art, can be made with a single upright or with a double upright as depicted in FIGS. 13 to 16.

The apparatus 100' can further comprise transfer and/or support means 170' of the pallet 500.

In particular, the base 520 of the pallet 500 rests on said transfer and/or support means 170' which are suitably configured to move the pallet 500 into the undressing position and to support it during undressing operations. We will not go into detail about said transfer and/or support means 170' as they are known to a person skilled in the art as conveyors with chains, rollers, etc. which are chosen for example according to the type of the base 520 and/or the type of pallet 500. Said transfer and/or support means 170' have also been schematized in the figures.

Preferably, the apparatus 100' may comprise a lifting structure not depicted in the figure. Said lifting structure is configured to lift the pallet 500 from the transfer and/or support means 170' engaging on the base 520.

Again, we will not go into the technical details of the lifting structure as it can have different configurations depending on the type of the base 520 and/or the type of pallet 500, and said possible configurations are known to a person skilled in the art.

The main purpose of said lifting structure is to allow the cutting of the film 550 to be carried out throughout the entire height of the pallet 500 up to the base 520.

Said transfer and/or support means 170' are preferably positioned near the lifting structure 180' and, in case the lifting structure 180' is of the double upright type as depicted in FIGS. 13 to 16, said transfer and/or support means 170' are positioned inside the lifting structure 180', between the two aforesaid uprights 185'.

This allows the pallet 500 to be accommodated inside the lifting structure 180' in a central position for facilitating and speeding up undressing operations.

The lifting structure 180' is also configured to accommodate the movable frame 190'. In the case of a double-upright lifting structure 180', the movable frame 190' is inserted between the two uprights 185'.

Said movable frame 190' is configured to translate vertically on said lifting structure 180'.

Also in this case, the construction details of the lifting structure 180' and of the movable frame 190' will not be described herein as they are known to a person skilled in the art. The lifting structure 180' further preferably comprises vertical movement means 181' such as for example motors, transmission elements 182', etc., for moving the movable frame 190' in a vertical direction.

In accordance with a feature of the present invention said frame 190' is ring-shaped, i.e. it comprises a structure 191' with four load-bearing sides 191'*a*, each parallel to a side 502*a* of the pallet 500 and therefore configured to surround the pallet 500.

This shape allows the movable frame 190' to both operate above the pallet and therefore on the upper surface 501 thereof, and to operate over the entire height of the side surface 502, descending from the position above the pallet 500 until coming around the side surface 502.

Preferably, the movable frame 190' comprises two or four translating elements 192', parallel to the load-bearing sides 191'*a*; said translating elements 192' are preferably movable on a plane orthogonal to the upward/downward direction of the movable frame 190'.

In other words, the apparatus 100', further comprises a lifting structure 180' and a frame 190' that is movable vertically on said structure 180', and said frame 190' comprising a structure 191' configured to surround the perimeter of the pallet 500 and on which preferably at least two translating elements 192' preferably four translate horizontally, configured to approach or move away from a respective side 502*a* of the side surface 502 of the pallet 500.

In a preferred embodiment, the movable frame 190' is configured to support and move the withdrawal means 120' and/or the cutting devices 110' integrally in a vertical direction.

Preferably, each translating element 192' is configured to support and move a cutting device 110' integrally in the horizontal and vertical direction.

In particular, the cutting devices 110' are preferably installed on said translating elements 192'. In this way, each cutting device 110' translates in a vertical direction integrally with the movable frame 190' and in a horizontal direction integrally with the translating elements 192'.

The configuration with four translating elements 192' is depicted in FIGS. 13 to 23.

An advantageous aspect of this configuration is that it allows for example four cutting devices 110' to be installed, one on each translating element 192' of the frame 190'. As described above, this allows to speed up the cutting cycle of the apparatus 100'. In such a case, the gripping devices 121' are also preferably four in number to operate on each of the four segments 550*s* and preferably installed on the structure 191'.

A configuration not depicted in the figure may provide for the movable frame 190' with two translating elements 192' for example on opposite sides; in such a case, it may for example be contemplated to install two cutting devices 110' one of which on each translating element 192'*b* and preferably two gripping devices 121' installed on the structure 191'. In this way, it is possible to cut the film 550 only in one direction on the upper portion 551 and only on two opposite sides 502*a*.

In order to make the additional cuts required, for example to separate four segments 550*s*, it can be contemplated to rotate the pallet 500 by 90° once the first set of horizontal and vertical cuts has been made, and then to proceed with the second set of horizontal and vertical cuts.

In this configuration, the transfer and/or support means 170', preferably comprise a rotatable structure, not depicted in the figure, configured to rotate the pallet 500 by at least 90°.

Said rotatable structure in particular cooperates with the cutting device 110' in such a way that said cutting device 110' can perform the cutting steps as described above.

It is understood however that what is described above has a value of non-limiting example, therefore, possible variants of detail that may be necessary for technical and/or functional reasons, are considered from now on as falling within the same scope of protection.

For example, an anthropomorphic robot configured to support and move one or more cutting elements 110' and/or withdrawal means 120' may be envisaged instead of an apparatus 100' with a lifting structure 180' and a movable frame 190'.

After the cut of the film 550 has been carried out according to the embodiments described above, the film 550 is withdrawn from the pallet 500 by means of the withdrawal means 120' and brought to the evacuation device 130'.

In particular, the evacuation device 130' comprises dragging means 140' configured to receive the upper flap 551*s* from the withdrawal means 120' and exert traction forces on the segment 550*s* to move it away and/or detach it from the pallet 500 and preferably from the base 520 or from a possible second film adhering to said base 520.

Often in fact, in order to better isolate the product 510, the pallet 500 can provide for a second film placed between the base 520 and the first product layer 510. Said second film is often in adhesion to the film 550, said adhesion due above all to heat-shrinking.

Said dragging means 140' may comprise at least one motorized roller 141' rotatable about its symmetry axis Preferably said motorized roller 141' has a toothed outer surface 141's, to facilitate the retention of the film 550.

Figure 26B:
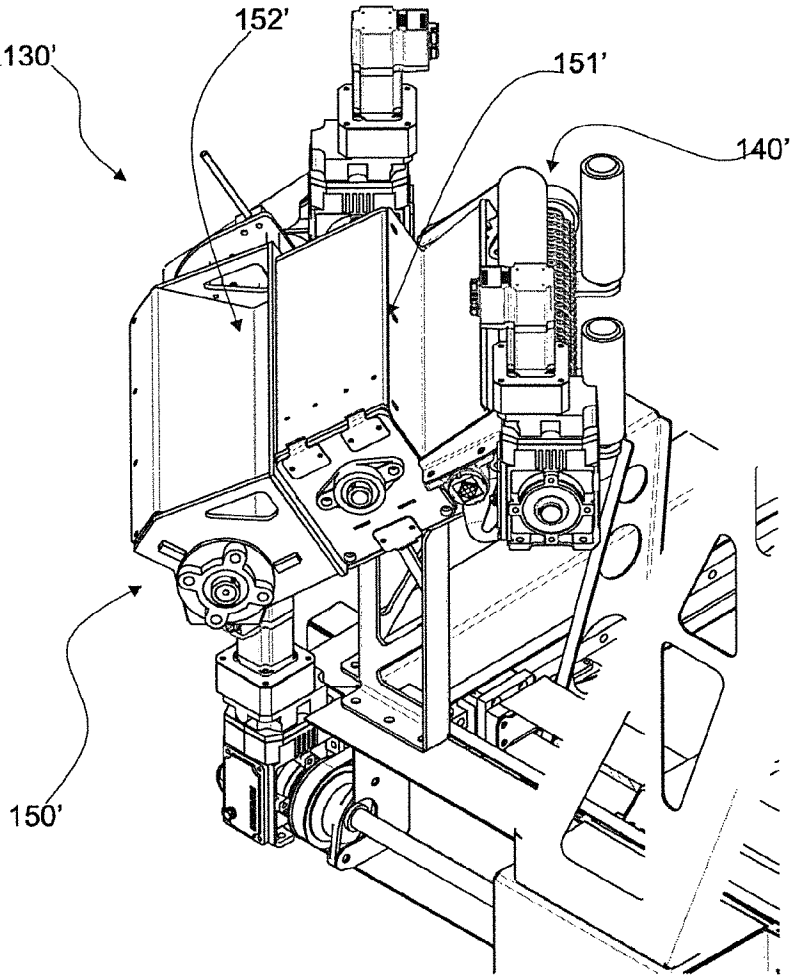
FIG. 26*a*, 26*b*, 26*c*: illustrates a side and axonometric view of the evacuation devices and related working steps.
Figure 26A:
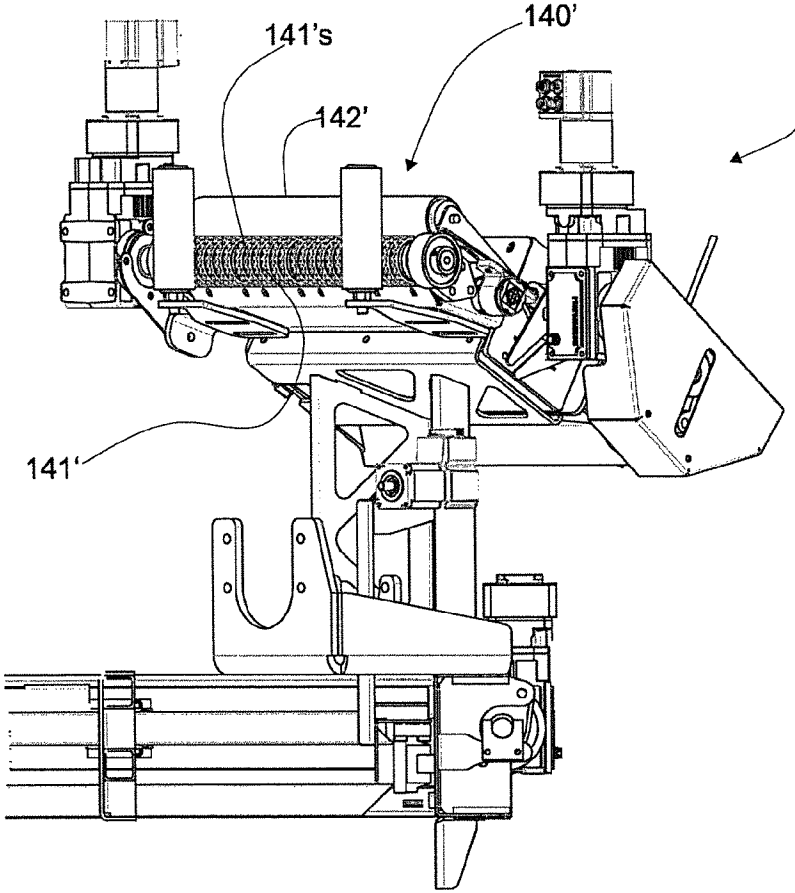
Figure 26C:
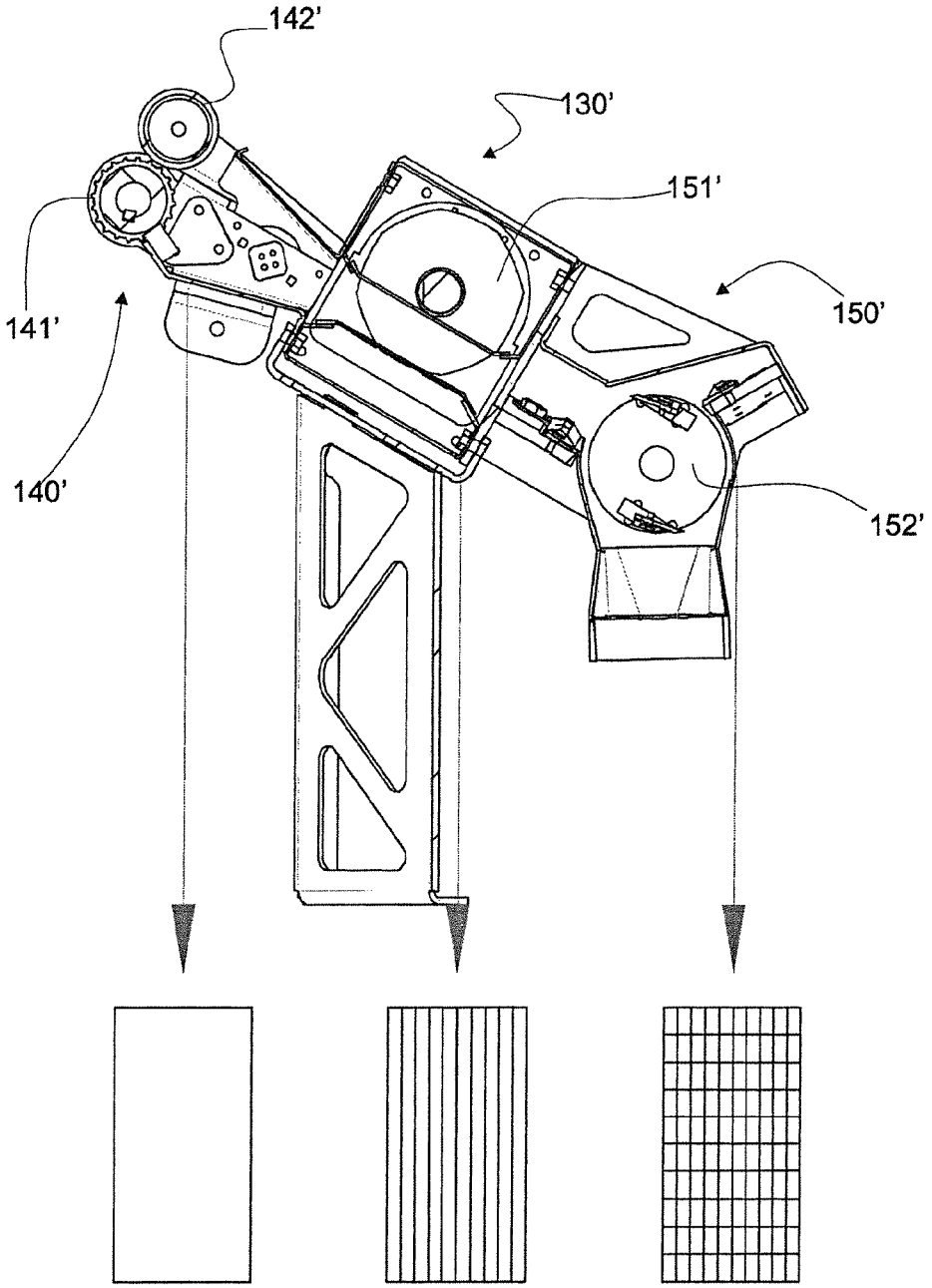

As depicted in FIG. 26, said motorized roller 141' can cooperate with a contrasting roller 142', preferably idle rotatable, adapted to press the film 550 on the motorized roller 141' increasing the adherence thereof.

A feature of the invention provides that said evacuation device 130' comprises shredding means 150' which are configured to cut/shred the film 550 of each segment 550*s* into small portions before their evacuation; preferably they are configured to cut/shred the upper flap 551*s* and progressively said lower flap 552*s*.

In particular, the shredding means 150' receive the upper flap 551*s* of each segment 550*s* from the dragging means 140'.

In fact, as depicted in FIG. 26, the shredding means 150' are preferably arranged in sequence to the dragging means 140'.

In a formulation of the present invention said shredding means 150' comprise a longitudinal cutting device 151' for cutting the film 550 into strips and a transversal cutting device 152' which operates in a direction preferably orthogonal to the longitudinal cutting device 151' for cutting the strips of film 550 into small pieces.

Preferably said devices 151', 152' operate in sequence and it is irrelevant whether the longitudinal cutting device 151' precedes or follows the transversal cutting device 152'.

As depicted in FIG. 26, the evacuation device 130' comprising the dragging means 140' and the shredding means 150' can be made as a single body. This facilitates the management and maintenance of the device.

In a preferred embodiment, the frame 190' is configured to support and move the evacuation devices 130' integrally in the vertical direction.

As depicted in FIG. 23, the evacuation devices 130' can be integral with the movable frame 190' and in this way they move together with the cutting devices 110' and/or the withdrawal means 120' facilitating the evacuation of the segments 550*s*. Consequently, also the dragging means 140', and the shredding means 150' can be integral with the movable frame 190'.

In particular, FIG. 23 depicts a preferred embodiment in which the evacuation devices 130' are four in number and preferably are integral with the structure 191' and preferably placed at the four corners of said structure 191'.

Said apparatus 100' further may comprise discharge means 160' which receive the shredded film 550 from the shredding means 150'.

Figure 14:
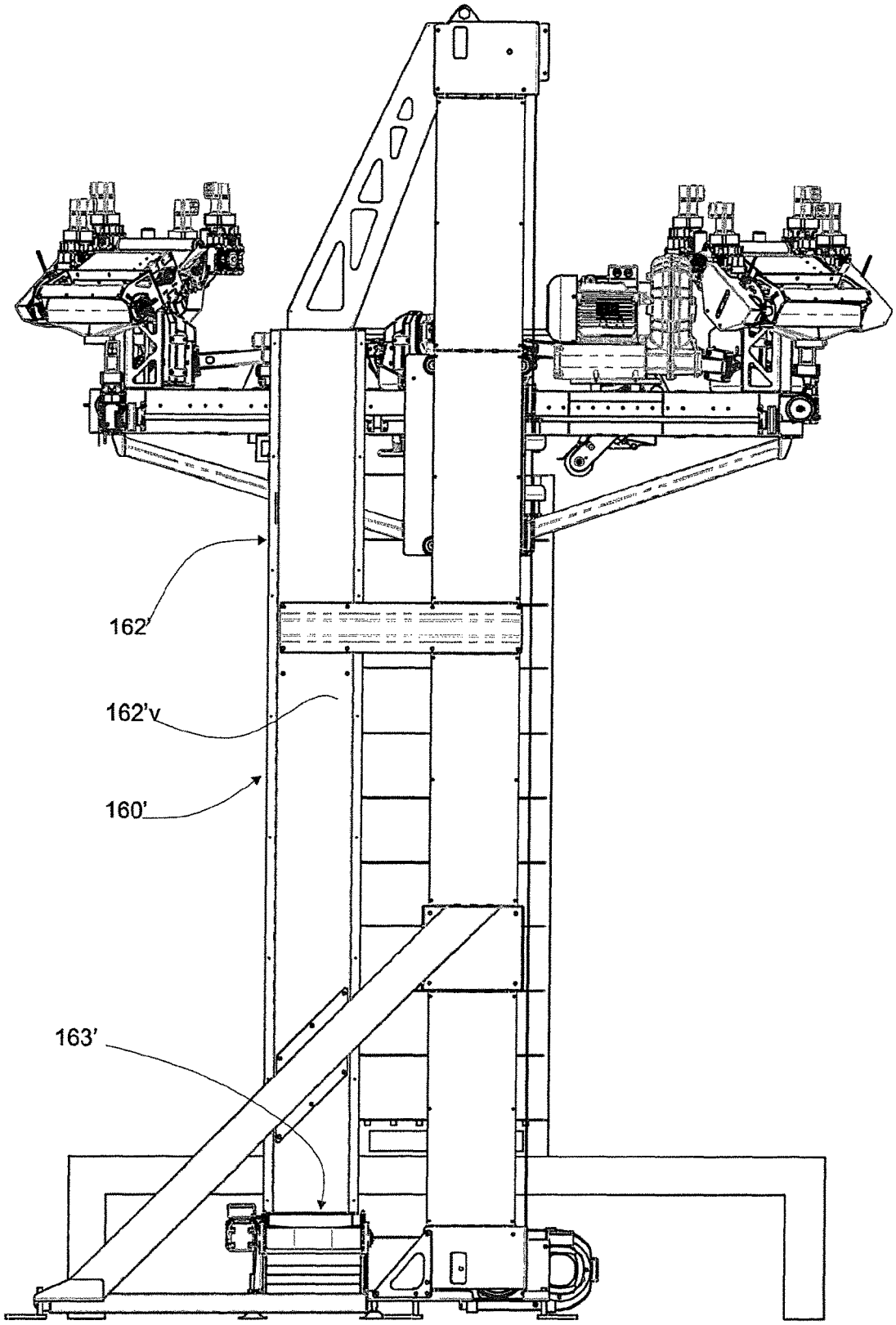
FIG. 14: illustrates a side view of an apparatus for undressing pallets according to the invention.

FIG. 14, 15 depicts a possible embodiment in which the discharge means 160' comprise a suction group 161' which, from the shredding means 150', conveys the shredded film 550 towards an evacuation conduit 162'.

For example, the suction group 161' comprises a blower or more than one, which, as known to a person skilled in the art, is configured to create a pressure reduction that allows suction. Other known systems adapted to generate a venturi or suction effect also fall within the scope of protection of the invention.

Preferably the discharge means 160' provide a centralized suction group 161' for all the evacuation devices 130'. Therefore, for example by means of pipings, the shredded film 550 is conveyed from the evacuation devices 130' to the evacuation conduit 162'.

Preferably said evacuation conduit 162' comprises a vertical portion 162'*v* from which said shredded film 550 is deposited by falling.

In this way, thanks to the evacuation conduit 162', the shredded film 550 is contained in a well defined area and thanks to the vertical portion 162'*v*, the force of gravity is exploited to convey and deposit the shredded film 550.

Figure 15:
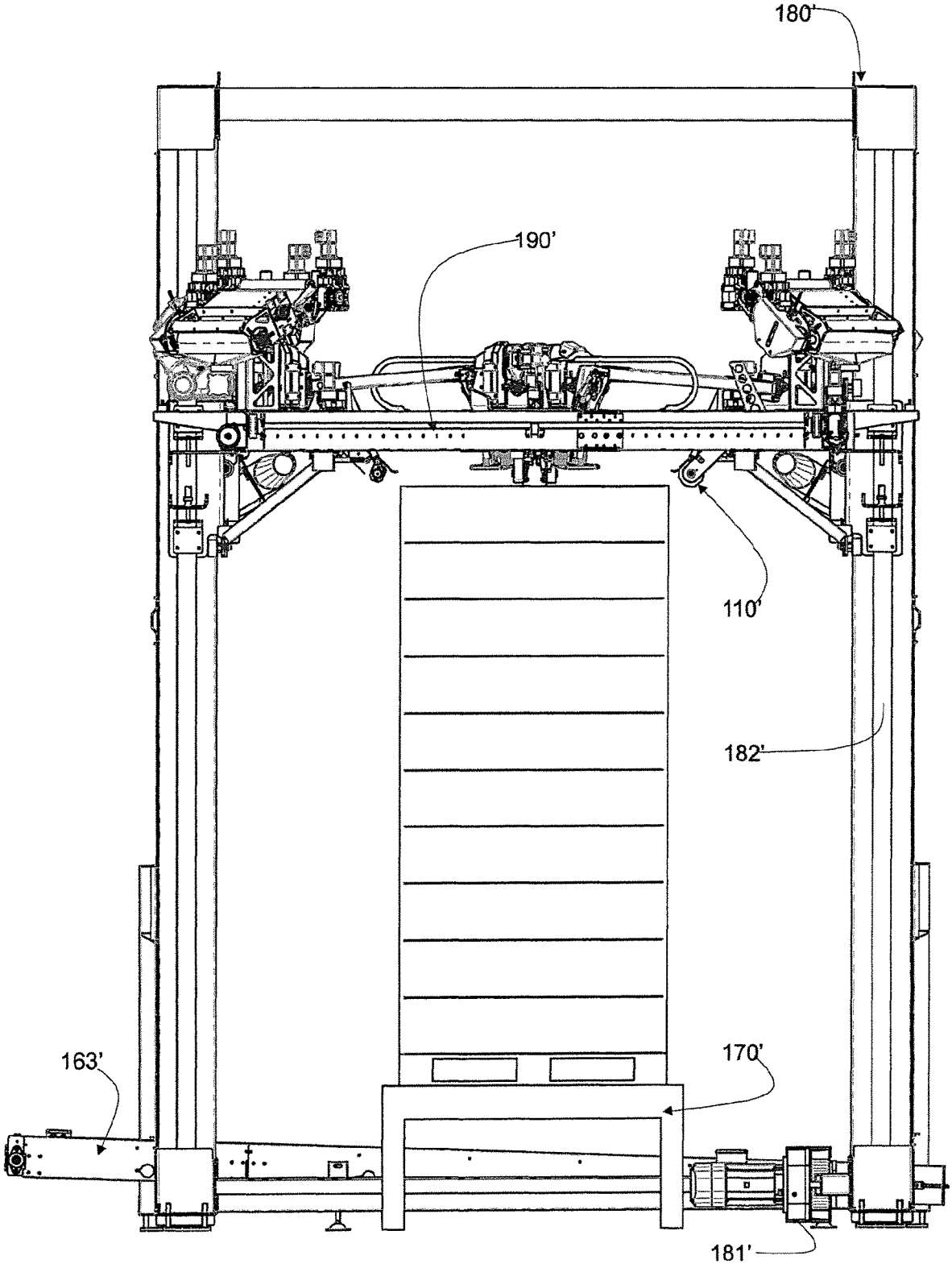
FIG. 15: illustrates a front view of an apparatus for undressing pallets according to the invention.
Figure 16:
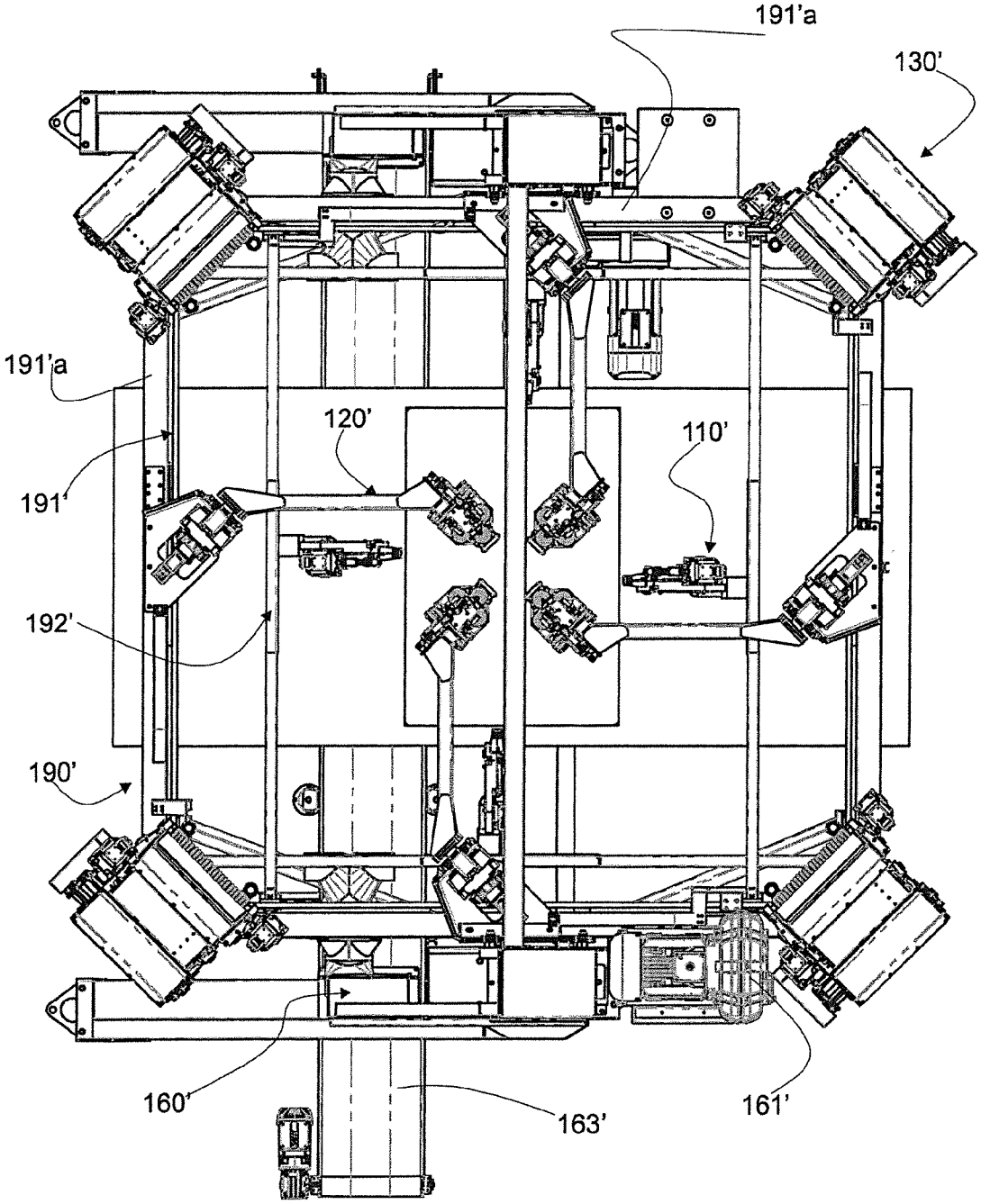
FIG. 16: illustrates a top view of an apparatus for undressing pallets according to the invention.
Figure 17A:
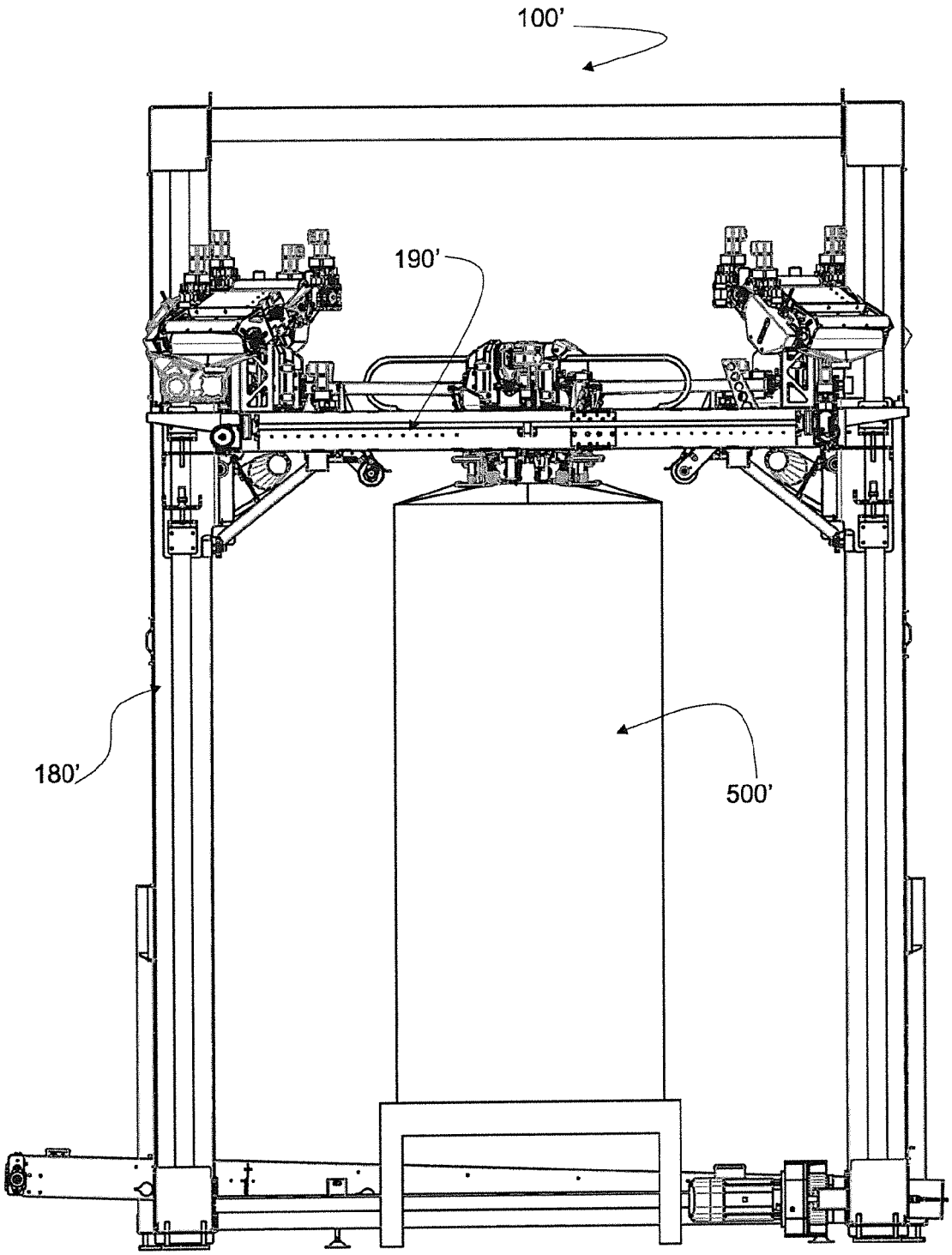
FIG. 17*a*, 17*b*, 17*c*: illustrates a front view, a top view and a detail view of the apparatus during step 1.
Figure 17C:
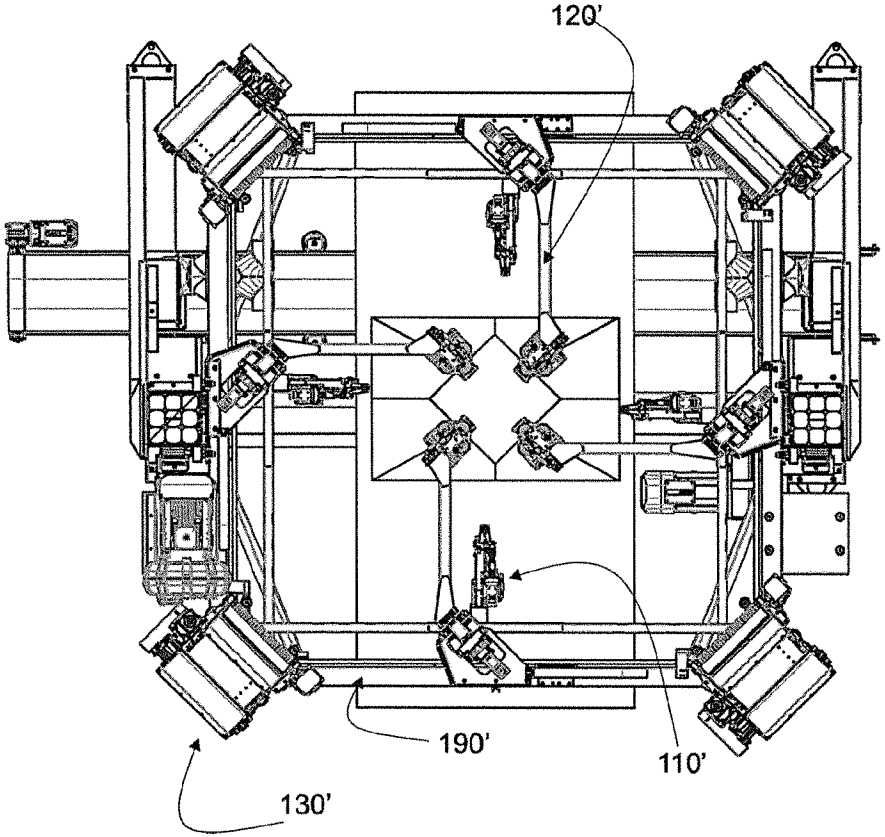
Figure 17B:
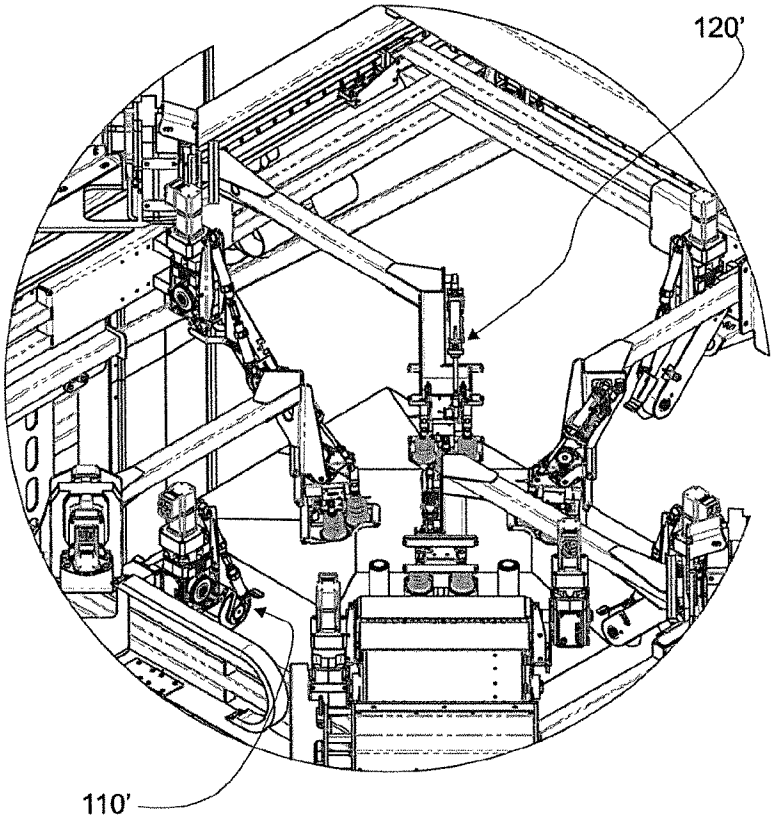
Figure 18B:
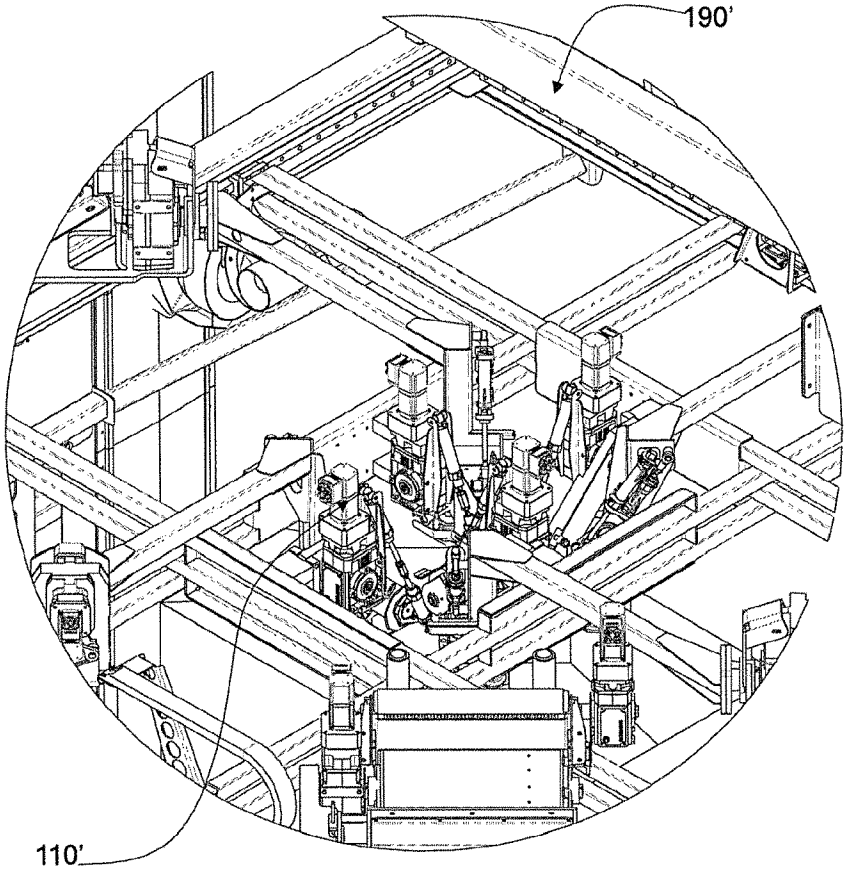
FIG. 18*a*, 18*b*: illustrates an axonometric view from above of the apparatus during step 2 and 3.
Figure 18A:
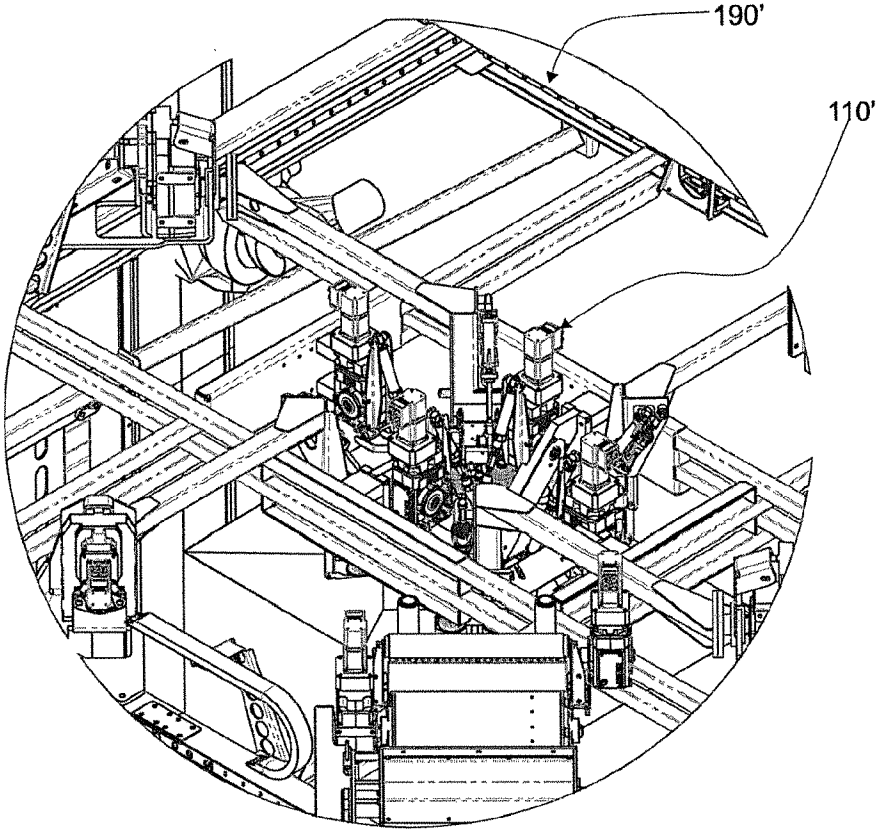
Figure 19B:
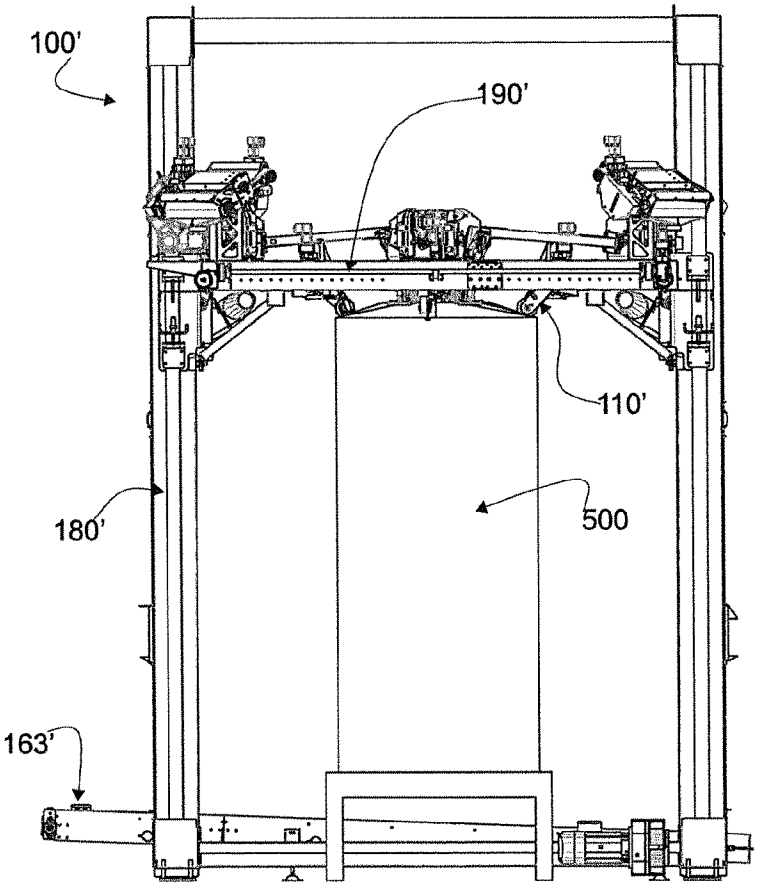
FIG. 19*a*, 19*b*: illustrates an axonometric view from above and front view of the apparatus during step 4.
Figure 19A:
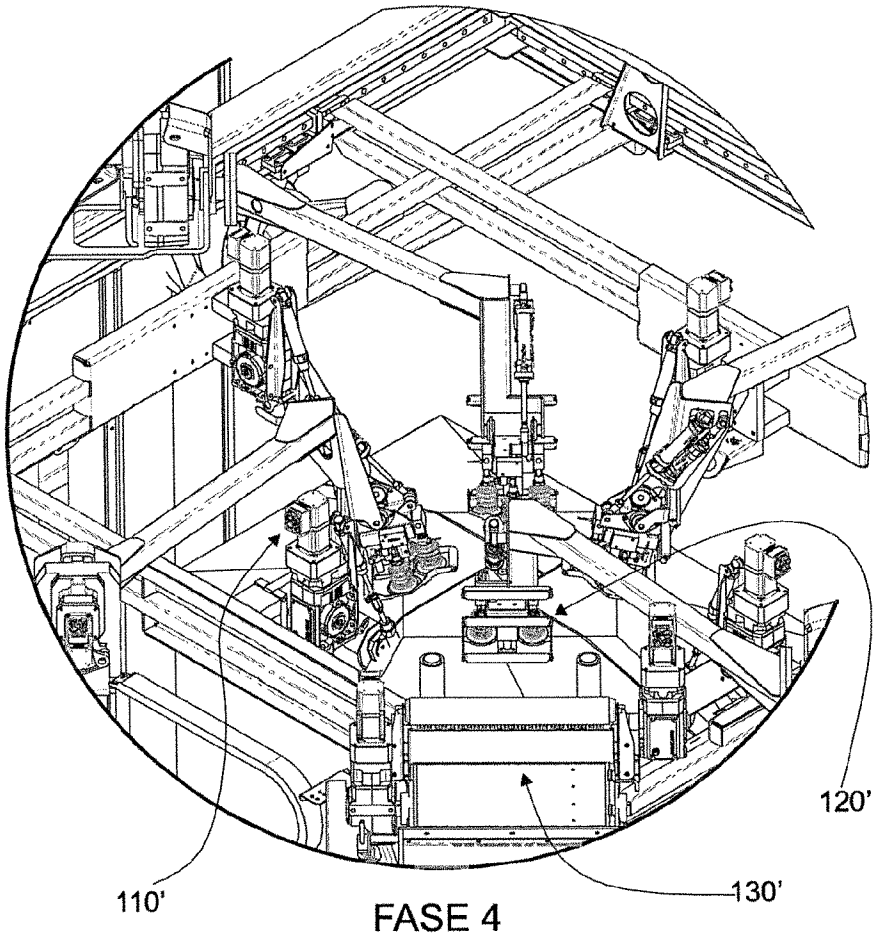
Figure 20:
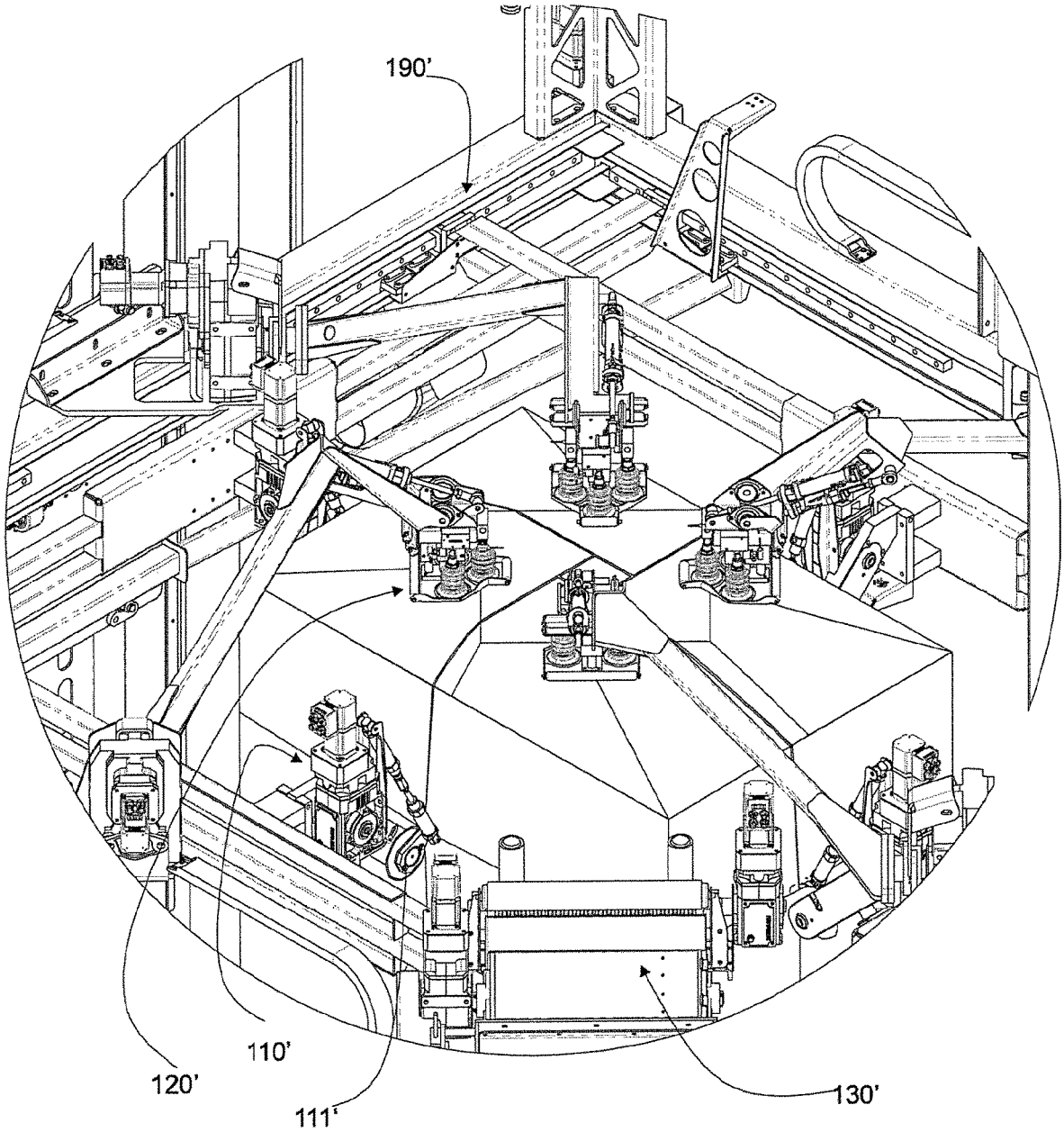
FIG. 20: shows an axonometric view from above of the apparatus during step 5.
Figure 21B:
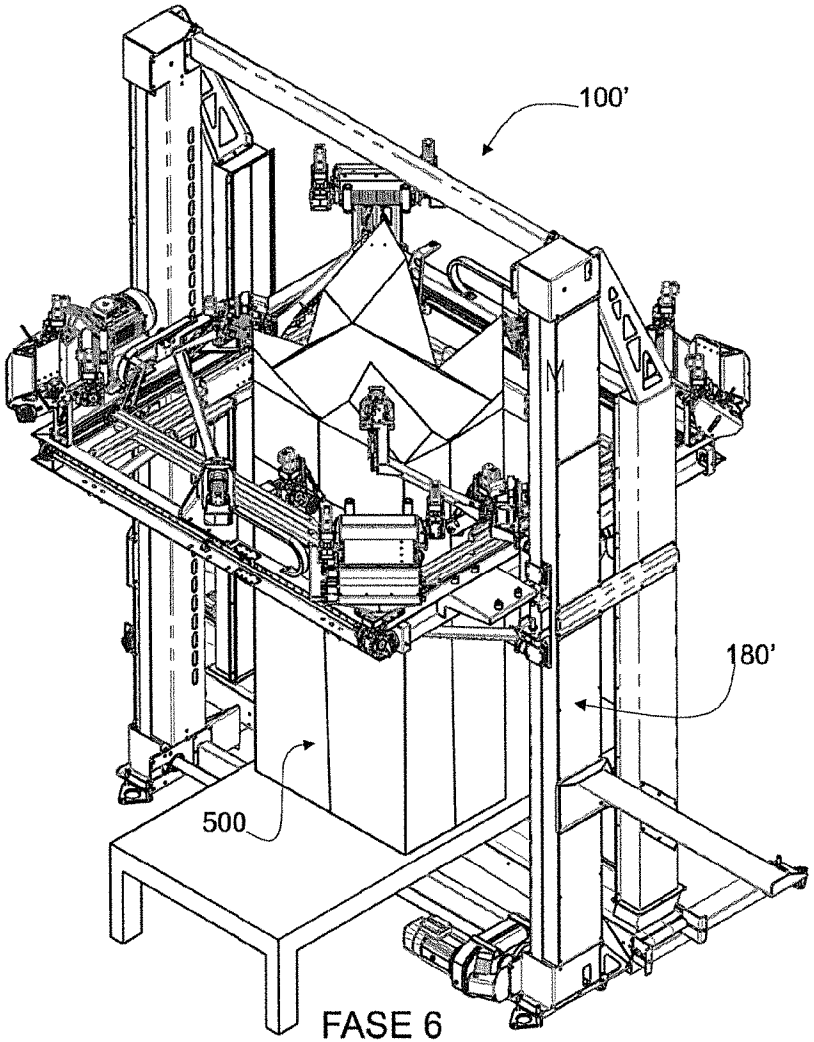
FIG. 21*a*, 21*b*: illustrates an axonometric, top view of the apparatus during step 6.
Figure 21A:
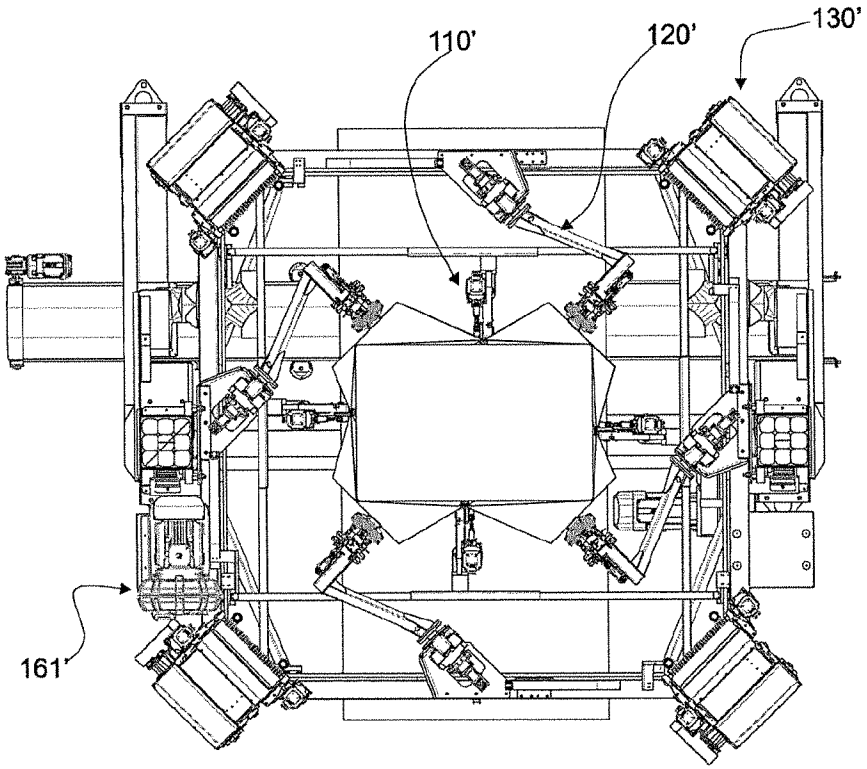
Figure 22B:
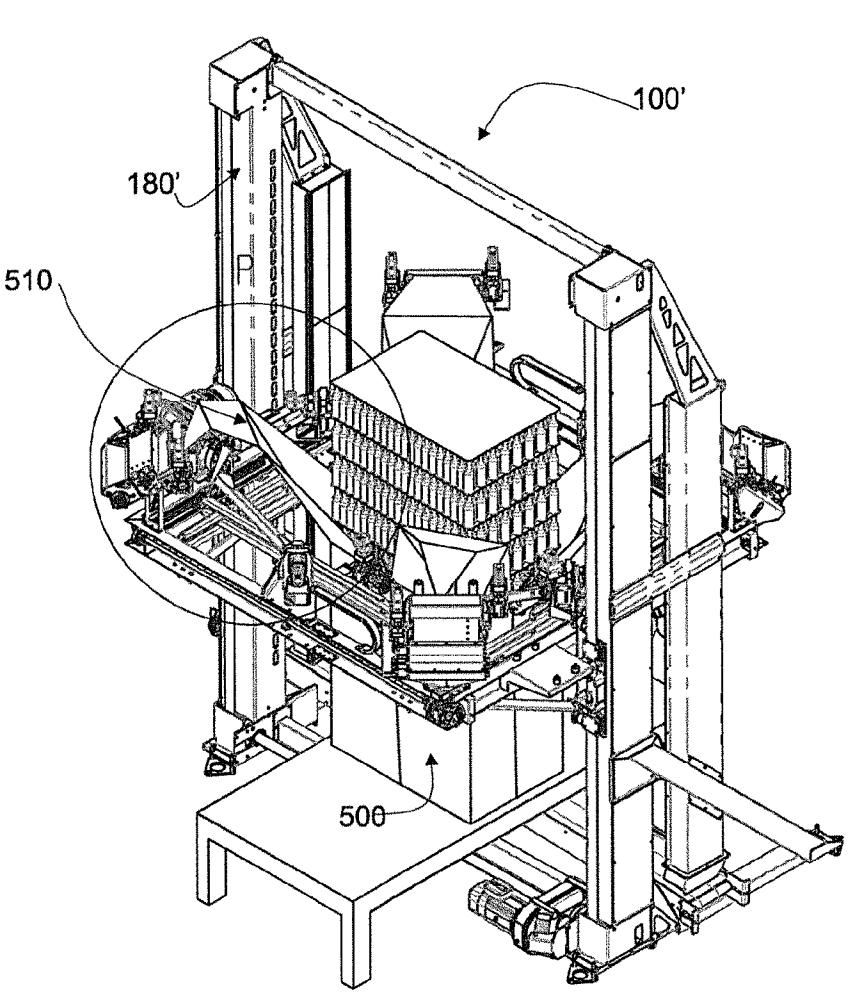
FIG. 22*a*, 22*b*: illustrates an axonometric view from above and related detail of the apparatus during step 7.
Figure 22A:
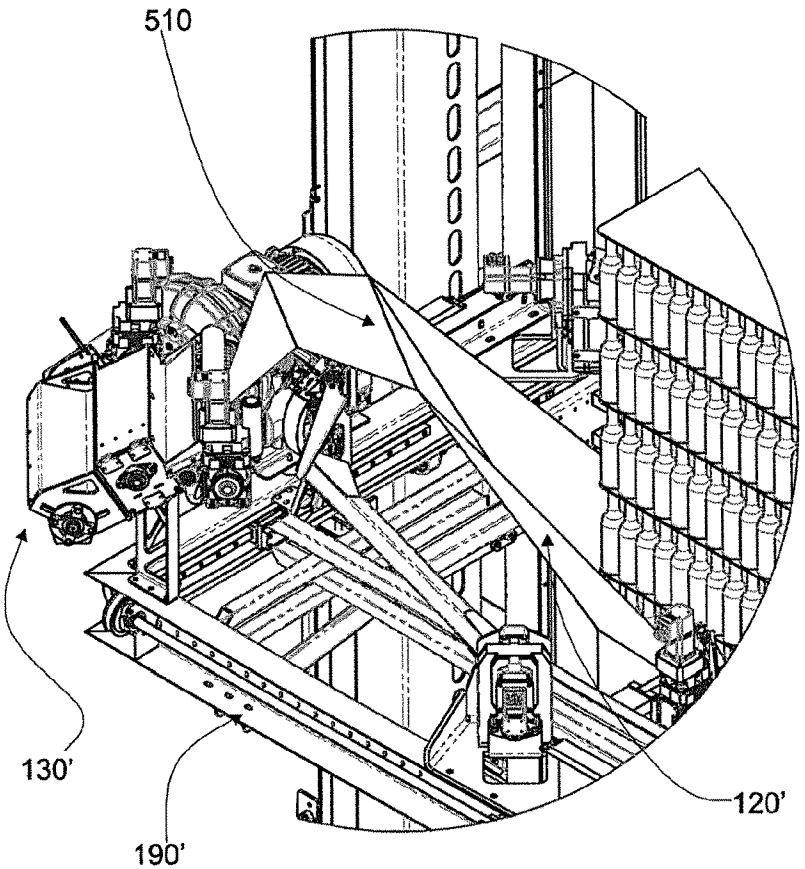
Figure 23B:
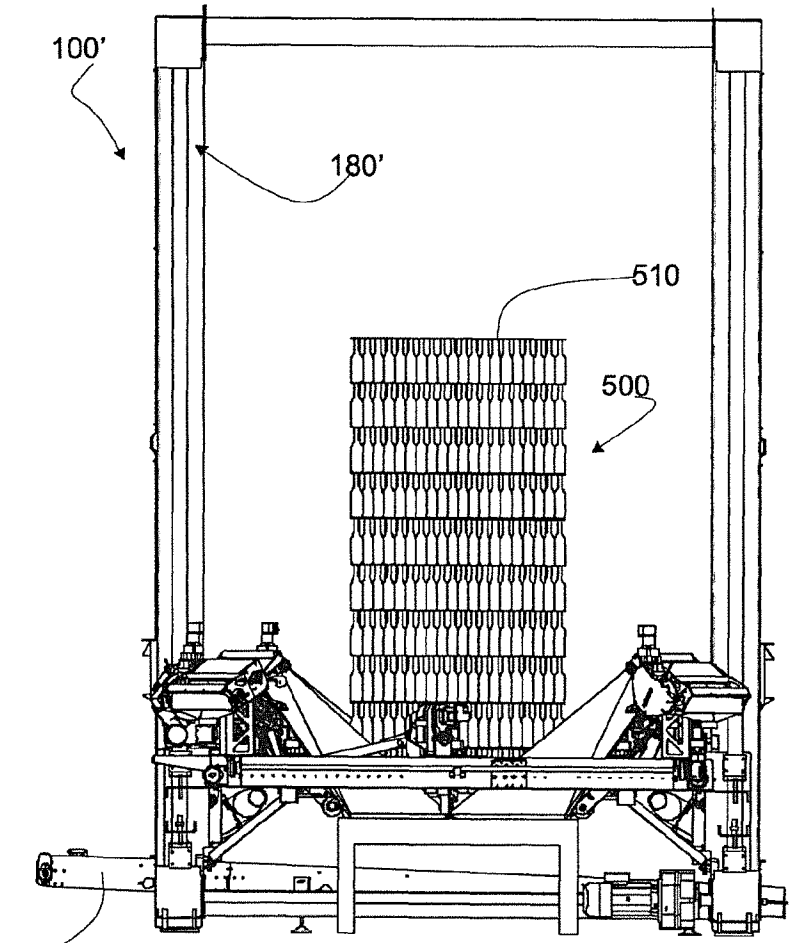
FIG. 23*a*, 23*b*: illustrates an axonometric view from above and related detail of the apparatus during step 8.
Figure 23A:
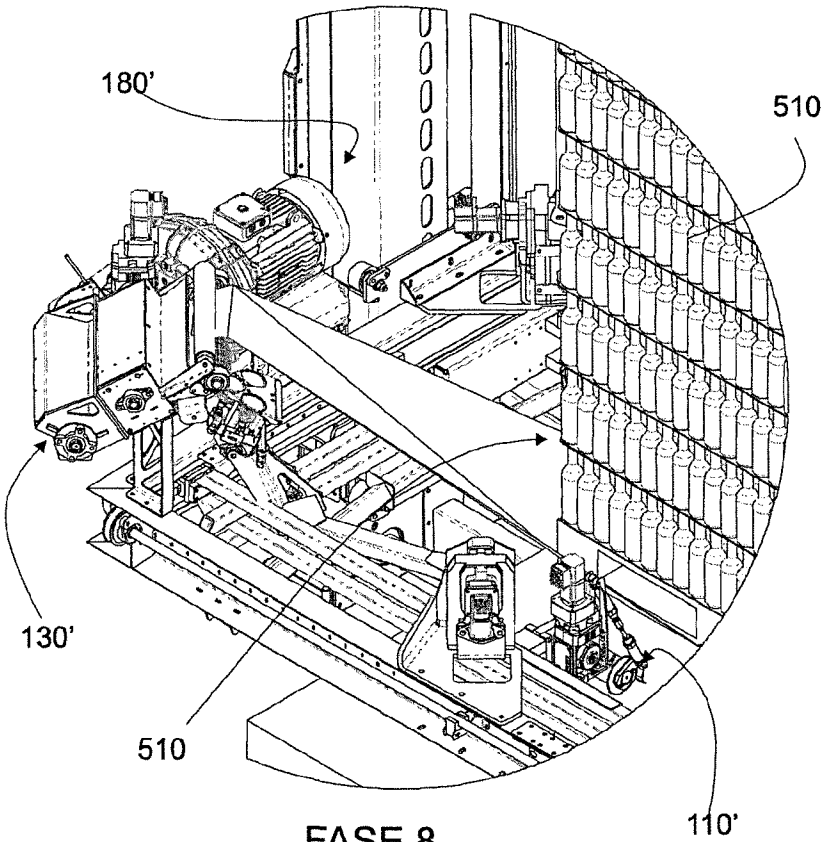

FIGS. 14, 15 depict the evacuation conduit 162' in a possible configuration which is particularly advantageous in terms of layout and mechanical resistance of the apparatus 100'. In fact, said evacuation conduit 162' is arranged parallel to the lifting structure 180'.

A conduit is also preferably provided at the side of each upright 185' of the lifting structure 180'.

Since, from the shredding means 150', the shredded film 550 is conveyed towards the evacuation conduit 162', in particular the vertical portion 162'*v* is configured to allow access of the shredded film 550 in whatever vertical position the movable frame 190' is placed, to which the evacuation devices 130' are integral.

A preferred configuration may provide that the vertical portion 162'*v* comprises deformable elements on the face facing the movable frame 190' so as to ensure access of the shredded film 550, but not the escape thereof.

For example, said deformable elements may be brushes, or rubber lips, etc.

As depicted in FIGS. 14, 15 the shredded film 550 exiting the vertical portion 162'*v* may be deposited for example on a conveyor belt 163'.

This configuration is particularly advantageous as it also automates the evacuation of the shredded 550 film by conveying it in the most suitable position for disposal.

FIG. 15 depicts a straight belt, but this is only a possible non-limiting configuration of the invention.

The invention also relates to the method for undressing a pallet 500 of products 510 preferably arranged in layers on a base 520 or plate, said pallet 500 being coated with a protective film 550 for retaining and protecting the products 510 themselves, configured to cover the upper surface 501 and the side surface 502 of the pallet 500 preferably up to the base 520.

Said method preferably provides for separating said protective film 550 into at least two segments 550*s* each comprising an upper flap 551*s* of an upper portion 551 of film 550 at the upper surface 501 of the pallet 500 and a lower flap 552*s* of a side portion 552 of film 550 at the side surface 502 of the pallet 500.

More particularly, the method provides for moving said segments 550*s* away first from the upper surface 501 of the pallet 500 and then from the side surface 502 of the pallet 500.

A preferred embodiment provides for separating said protective film 550 into a plurality of segments 550*s*, preferably four in number.

According to one aspect of the invention, the method provides for withdrawing the upper flap 551*s* of each segment 550*s* and bringing it towards shredding means 150 adapted to cut/shred the film 550 into small portions before their evacuation.

Furthermore, the method preferably provides for cutting/shredding said upper flap 551*s* and progressively said lower flap 552*s*.

In particular, it provides for bringing each segment 550*s* towards the dragging means 140' adapted to tension the film 550, before cutting/shredding it into small portions.

Thanks to this solution it is easier to detach the film 550 from the pallet 500.

Preferably the steps of separating by cutting and moving said segment 550*s* away from pallet 500 take place simultaneously.

In particular, the method provides for lifting the upper portion 551 of film 550 from the upper surface 501 of the pallet 500 before making the cut for the separation of the segments 550*s*.

Thanks to this solution, the initial cutting step is simpler, which reduces the contact of the blade 111' with the palletized product 510.

The specific constructive embodiment reported in FIGS. 10 to 26 is described below.

The apparatus 100' comprises the lifting structure 180' on which the movable frame 190' translates vertically.

Said movable frame 190' comprises the structure 191' on which the translating elements 192' are configured to approach or move away from a respective side 502*a* of the side surface 502 of the pallet 500.

Preferably on the structure 191', the withdrawal means 120' are installed with for example four gripping devices 121' and four evacuation devices 130' are preferably installed.

A cutting device 110' is installed on each of the four translating elements 192'.

The discharge means 160' communicating with the evacuation devices 130', are associated with the lifting structure 180' and provide two evacuation conduits 162' at each upright 185'.

An example of a working cycle envisages bringing the pallet 500 to be undressed into the working position inside the apparatus 100' and preferably inside the lifting structure 180'.

The movable frame 190' descends near the upper surface 501 of the pallet 500.

The withdrawal means 120' approach the upper portion 551 of the film 550 and by means of the grasping heads 122' partially move the upper portion 551 away from the upper surface 501.

At this point the cutting devices 110' start cutting the upper portion 551 into upper flaps 551*s*.

In particular, the retaining means 113' are arranged so that the rest element 113'*a* is brought below the cut film 550, retaining the film 550 in contact with the blade 111'. This occurs immediately after the start of the cut.

The cut can take place according to various embodiments described above. For example, by approaching the translating elements 192' the cutting devices 110' position themselves in the middle of the upper surface 501 and start cutting into 4 segments 550*s*.

Once the horizontal cutting has been finished the activation means 113'*b* bring the rest element 113'*a* into the second working position, i.e. suitable for vertical cutting.

The rest element 113'*a* passes from the first horizontal cutting position to the second vertical cutting position gradually, adapting according to the resistance the film 550 opposes.

The withdrawal means 120' move the upper flaps 551*s* away from the upper surface 501 and release them to the evacuation devices 130'.

Preferably this takes place after cutting at least a portion of the lower flaps 552*s*, so as to have a sufficient amount of film 550 which allows to reach said evacuation devices 130'.

Once the upper flaps 551*s* are released to the evacuation devices 130', as the cutting of the lower flap 552*s* continues, the evacuation devices 130' receive the entire segment 550*s*.

The withdrawal means 120' move to an out-of-space position awaiting the new working cycle.

At the same time the evacuation devices 130' perform the cutting/shredding of the upper flaps 551*s*.

The cutting devices 110' continue the cutting the side portion 552 into lower flaps 552*s*.

The evacuation devices 130' exert a traction on the upper flaps 551*s* and on the lower flaps 552*s* which facilitates the continuation of the cut.

The lower flaps 552*s* of film are progressively cut/shredded.

At the same time, as each segment 550*s* is progressively cut/shredded, it is conveyed by suction through the evacuation conduits 162' until it is deposited on a conveyor belt 163'.

Therefore, after positioning the pallet 500 inside the apparatus 100', the following steps can be summarized:

Step 1 (depicted in FIGS. 17*a*, 17*b*): movement of the upper portion 551 away from the upper surface 501 of the pallet 500;

Step 2 (depicted in FIG. 18*a*): beginning of the cutting of the upper portion 551 in a first direction and preferably positioning the retaining means 113' between the product 510 and the cut film 550, retaining it in contact with the blade 111', continuation of the cutting;

Step 3 (depicted in FIG. 18*b*): beginning of the cutting of the upper portion 551 in a second direction and preferably positioning the retaining means 113' between the product 510 and the cut film 550, retaining it in contact with the blade 111', continuation of the cutting;

Step 4 (depicted in FIGS. 19*a*, 19*b*): completion of cutting of the upper portion 551 into upper flaps 551*s* in the first direction and in the second direction, lifting each upper flap 551*s* and movement away from upper surface 501;

Step 5 (depicted in FIG. 20): continuation of the cut along the side portion 552 of film 550 into lower flaps 552*s;*

Step 6 (depicted in FIGS. 21*a*, 21*b*): complete lifting of each upper flap 551*s*, movement away from the upper surface 501, towards the evacuation devices 130';

Step 7 (depicted in FIG. 22*a*, 22*b*): release of each upper flap 551*s* to the evacuation devices 130' and start of cutting/shredding the upper flaps 551*s;*

Step 8 (depicted in FIGS. 23*a*, 23*b*): movement of the lower flaps 552*s* away from the side surface 502 of the pallet 500;

Step 9 (not depicted in the figure): continuation of the cutting/shredding of the lower flaps 552*s;*

Step 10 (not depicted in the figure): discharge of the shredded film 550 for disposal.

It is understood however that what is described above has a value of non-limiting example; therefore possible detail variants that may be required for technical and/or functional reasons are considered from now as falling within the same scope of protection defined by the claims reported below.

The invention claimed is:

1. Method for undressing a pallet of products arranged in layers on a base, said pallet being coated with a protective film for retaining and protecting the products the film being configured to cover an upper surface and a side surface of the pallet up to the base, the method comprising:

cutting said protective film into at least two segments each comprising an upper flap of an upper portion of film at the upper surface of the pallet, and a lower flap of a side portion of film at the side surface of the pallet and moving away said at least two segments from the upper surface of the pallet and from the side surface of the pallet;

wherein cutting said protective film into said at least two segments is carried out before moving away said at least two segments and comprises:

cutting a first cut and a second cut at said side surface; at least one horizontal cut at said upper surface; and cutting a lower cut near or proximate to the base, said lower cut extending in a substantially horizontal direction along each side of the side surface and wherein at least one of said first cut or said second cut intersects said lower cut, wherein cutting said lower cut comprises:

cutting a first portion and a second portion of said lower cut, respectively on two successive side faces of the side surface, rotating the pallet around a vertical symmetry axis thereof, after cutting the first portion and the second portion of said lower cut, and cutting a third portion and a fourth portion of said lower cut, respectively on two remaining successive side faces of the side surface, after rotating the pallet wherein said first cut and second cut are horizontally spaced apart from each other on said side surface and vertically extend up to said upper surface so as to end or start at respective opposite ends of said horizontal cut.

2. The method according to claim 1, wherein said first cut and second cut are cut on the side surface in diametrically opposite positions, with respect to a vertical symmetry axis of the pallet.

3. The method according to claim 1, wherein said first cut and said second cut are in continuity with the respective ends of said horizontal cut.

4. The method according to claim 1, wherein the horizontal cut comprises:

a first upper section and second upper section extending up to the center of the upper surface and starting, respectively, from opposite side faces of said side surface.

5. The method according to claim 4, wherein said first upper section and second upper section are cut in continuity with the first cut and second-cut, respectively.

6. The method according to claim 1, wherein the first cut intersects the first portion or the second portion of said lower cut, and wherein the second cut intersects the third portion or the fourth portion of said lower cut.

7. The method according to claim 1, wherein moving away said at least two segments is carried out by a withdrawal device installed on an anthropomorphic robot.

8. The method according to claim 1, wherein the method further comprises:

performing a centering step of the pallet with respect to a vertical symmetry axis thereof, before moving away said at least two segments.

9. Method for undressing a pallet of products arranged in layers on a base, said pallet being coated with a protective film for retaining and protecting the products the film being configured to cover an upper surface and a side surface of the pallet up to the base, the method comprising:

cutting said protective film into at least two segments each comprising an upper flap of an upper portion of film at the upper surface of the pallet, and a lower flap of a side portion of film at the side surface of the pallet, moving away said at least two segments from the upper surface of the pallet and from the side surface of the pallet;

wherein cutting said protective film into said at least two segments is carried out before moving away said at least two segments and comprises:

cutting a first cut and a second cut at said side surface; and at least one horizontal cut at said upper surface;

wherein the method further comprises:

rotating the pallet around a vertical symmetry axis thereof, after cutting said first cut and before cutting said second cut.

10. Apparatus for undressing a pallet of products arranged in layers on a base, said pallet being coated with a protective film for retaining and protecting the products, the film being configured to cover an upper surface and a side surface of the pallet at least up to the base, wherein said apparatus comprises:

a cutting device for performing the cutting of the protective film said cutting device being configured to cut:

a first cut and a second cut at said side surface and at least one horizontal cut at said upper surface so as to cut said protective film into at least two segments, each comprising an upper flap of an upper portion of film, at said upper surface, and a lower flap of a side portion of film, at said side surface;

a withdrawal device for moving away said at least two segments, after cutting said protective film into said at least two segments; and transfer and/or support means configured to position the pallet in a work area and wherein said transfer and/or support means comprise a rotating device configured to rotate the pallet around a vertical symmetry axis thereof, when the pallet is positioned at said work area, wherein said first cut and second cut are horizontally spaced apart from each other on said side surface and vertically extend up to said upper surface so as to end or start at respective opposite ends of said horizontal cut.

11. The apparatus according to claim 10, wherein said withdrawal device is installed on a first anthropomorphic robot.

12. The apparatus according to claim 10, wherein said cutting device is installed on a second anthropomorphic robot.

13. The apparatus according to claim 12, wherein said withdrawal device is installed on said second anthropomorphic robot.

14. The apparatus according to claim 10, further comprising a centering device configured to perform a centering step on said pallet with respect to a vertical symmetry axis thereof.

15. The apparatus according to claim 10, wherein the cutting device comprises:

a blade, and adaptation elements supporting the blade and configured to adapt the blade to the shape of the pallet.

16. The apparatus, according to claim 10, wherein the cutting device comprises:

a blade, and a protective element configured to be interposed between the products and the protective film during cutting, so as to retain said protective film proximate the blade.

17. The apparatus according to claim 16, wherein the protective element is in a fixed position with respect to the blade and is configured such that the blade is embedded in the thickness of said protective element, without protruding therefrom.

* * * * *